US007271688B1

(12) United States Patent
Beerling et al.

(10) Patent No.: US 7,271,688 B1
(45) Date of Patent: Sep. 18, 2007

(54) THREE-STAGE LIQUID METAL SWITCH

(75) Inventors: Timothy Beerling, San Francisco, CA (US); Steven A. Rosenau, Mountain View, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 11/240,998

(22) Filed: Sep. 30, 2005

(51) Int. Cl.
*H01H 29/00* (2006.01)

(52) U.S. Cl. ..... 335/47; 335/48; 335/49; 335/56; 335/58; 200/182; 200/187; 200/188; 200/234

(58) Field of Classification Search ..... 200/182, 200/187, 188, 233, 234; 335/47–58
See application file for complete search history.

(56) References Cited

U.S. PATENT DOCUMENTS 6,911,132 B2 * 6/2005 Pamula et al. ..... 204/600
6,989,234 B2 * 1/2006 Kolar et al. ..... 435/6
2003/0205632 A1 * 11/2003 Kim et al. ..... 239/690
2005/0032240 A1 * 2/2005 Lee et al. ..... 436/180
2005/0178286 A1 * 8/2005 Bohn et al. ..... 106/16
2006/0024478 A1 * 2/2006 D'Urso et al. ..... 428/156
2006/0024508 A1 * 2/2006 D'Urso et al. ..... 428/426
2006/0081643 A1 * 4/2006 Haluzak et al. ..... 222/52

* cited by examiner

*Primary Examiner*—Ramon M. Barrera

(57) ABSTRACT

A three-stage liquid metal switch employing electrowetting on dielectric (EWOD), including a common EWOD switch 1310 having an input port 1302, a first shared-EWOD-switch output 1336, and a second shared-EWOD-switch output 1338; a first EWOD switch 1340 having a first-EWOD-switch input 1343, a first output port 1304, and a first-EWOD-switch output 1368; and a second EWOD switch 1370 having a second-EWOD-switch input 1373, a second output port 1306, and a second-EWOD-switch output 1398; wherein the first shared-EWOD-switch output 1336 is operably connected to the first-EWOD-switch input 1343, and the second shared-EWOD-switch output 1338 is operably connected to the second-EWOD-switch input 1373.

20 Claims, 15 Drawing Sheets

THREE-STAGE LIQUID METAL SWITCH

BACKGROUND OF THE INVENTION

Many different technologies have been developed for fabricating switches and relays for low frequency and high frequency switching applications. Many of these technologies rely on solid, mechanical contacts that are alternatively actuated from one position to another to make and break electrical contact. Unfortunately, mechanical switches that rely on solid—solid contact are prone to wear and are subject to a condition known as "fretting." Fretting refers to erosion that occurs at the points of contact on surfaces. Fretting of the contacts is likely to occur under load and in the presence of repeated relative surface motion. Fretting typically manifests as pits or grooves on the contact surfaces and results in the formation of debris that may lead to shorting of the switch or relay.

To minimize mechanical damage imparted to switch and relay contacts, switches and relays have been fabricated using liquid metals to wet the movable mechanical structures to prevent solid to solid contact. Unfortunately, as switches and relays employing movable mechanical structures for actuation are scaled to sub-millimeter sizes, challenges in fabrication, reliability and operation begin to appear. Micromachining fabrication processes exist to build micro-scale liquid metal switches and relays that use the liquid metal to wet the movable mechanical structures, but devices that employ mechanical moving parts can be overly-complicated, thus reducing the yield of devices fabricated using these technologies. Therefore, a switch with no mechanical moving parts may be more desirable.

In some applications, such as high frequency switching, liquid metal switches can provide poor isolation. A signal that is supposed to be isolated by the open contacts of the switch can leak across the open contacts, causing intermittent errors and unintended results. Lack of reliable isolation results in lack of circuit reliability.

It would be desirable to have a three-stage liquid metal switch that would overcome the above disadvantages.

SUMMARY OF THE INVENTION

One aspect of the present invention provides a three-stage liquid metal switch employing electrowetting on dielectric (EWOD), including a common EWOD switch having an input port, a first shared-EWOD-switch output, and a second shared-EWOD-switch output; a first EWOD switch having a first-EWOD-switch input, a first output port, and a first-EWOD-switch output; and a second EWOD switch having a second-EWOD-switch input, a second output port, and a second-EWOD-switch output; wherein the first shared-EWOD-switch output is operably connected to the first-EWOD-switch input, and the second shared-EWOD-switch output is operably connected to the second-EWOD-switch input.

Another aspect of the present invention provides a three-stage liquid metal switch, including a first liquid metal droplet; means for supporting the first liquid metal droplet; means for translating the first liquid metal droplet between a first first-switch position operably connecting an input port to a first first-switch output and a second first-switch position operably connecting the input port to a second first-switch output in response to a first control signal; a second liquid metal droplet; means for supporting the second liquid metal droplet; means for translating the second liquid metal droplet between a first second-switch position and a second second-switch position in response to a second control signal, the first second-switch position operably connecting a second-switch input and a first output port; a third liquid metal droplet; means for supporting the third liquid metal droplet; means for translating the third liquid metal droplet between a first third-switch position and a second third-switch position in response to a third control signal, the first third-switch position operably connecting a third-switch input and a second output port; wherein the first first-switch output is operably connected to the second-switch input and the second first-switch output is operably connected to the third-switch input.

Yet another aspect of the present invention provides a three-stage liquid metal switch employing electrowetting on dielectric (EWOD), including a common EWOD switch having an input port, a first shared-EWOD-switch output, a second shared-EWOD-switch output, a shared-EWOD-switch liquid metal droplet, and at least one pair of shared-EWOD-switch electrodes, the shared-EWOD-switch liquid metal droplet being switchable in response to a shared-EWOD-switch control signal to the at least one pair of shared-EWOD-switch electrodes between a first shared-EWOD-switch position operably connecting the input port and the first shared-EWOD-switch output and a second shared-EWOD-switch position operably connecting the input port and the second shared-EWOD-switch output; a first EWOD switch having a first-EWOD-switch input, a first output port, a first-EWOD-switch output, a first-EWOD-switch liquid metal droplet, and at least one pair of first-EWOD-switch electrodes, the first-EWOD-switch liquid metal droplet being switchable in response to a first-EWOD-switch control signal to the at least one pair of first-EWOD-switch electrodes between a first first-EWOD-switch position and a second first-EWOD-switch position; and a second EWOD switch having a second-EWOD-switch input, a second output port, a second-EWOD-switch output, a second-EWOD-switch liquid metal droplet, and at least one pair of second-EWOD-switch electrodes, the second-EWOD-switch liquid metal droplet being switchable in response to a second-EWOD-switch control signal to the at least one pair of second-EWOD-switch electrodes between a first second-EWOD-switch position and a second second-EWOD-switch position; wherein the first shared-EWOD-switch output is operably connected to the first-EWOD-switch input, and the second shared-EWOD-switch output is operably connected to the second-EWOD-switch input.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE INVENTION

The switch structures described below can be used in any application where it is desirable to provide fast, reliable switching. While described below as switching a radio frequency (RF) signal, the architectures can be used for other switching applications.

Figure 1A:
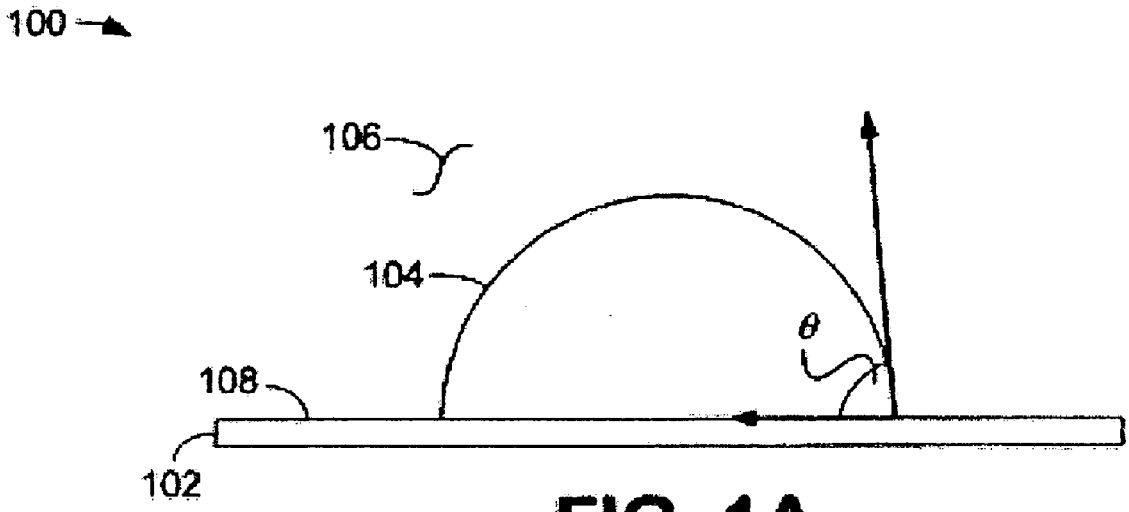
FIG. 1A is a schematic diagram illustrating a system including a droplet of conductive liquid residing on a solid surface.

FIG. 1A is a schematic diagram illustrating a system 100 including a droplet of conductive liquid residing on a solid surface. The droplet 104 can be, for example, mercury or a gallium alloy, and resides on a surface 108 of a solid 102. A contact angle, also referred to as a wetting angle, is formed where the droplet 104 meets the surface 108. The contact angle is indicated as θ and is measured at the point at which the surface 108, liquid 104, and gas 106 meet. The gas 106 can be, in this example, air, or another gas that forms the atmosphere surrounding the droplet 104. A high contact angle, as shown in FIG. 1A, is formed when the droplet 104 contacts a surface 108 that is referred to as relatively non-wetting, or less wettable. The wettability is generally a function of the material of the surface 108 and the material from which the droplet 104 is formed, and is specifically related to the surface tension of the liquid.

Figure 1B:
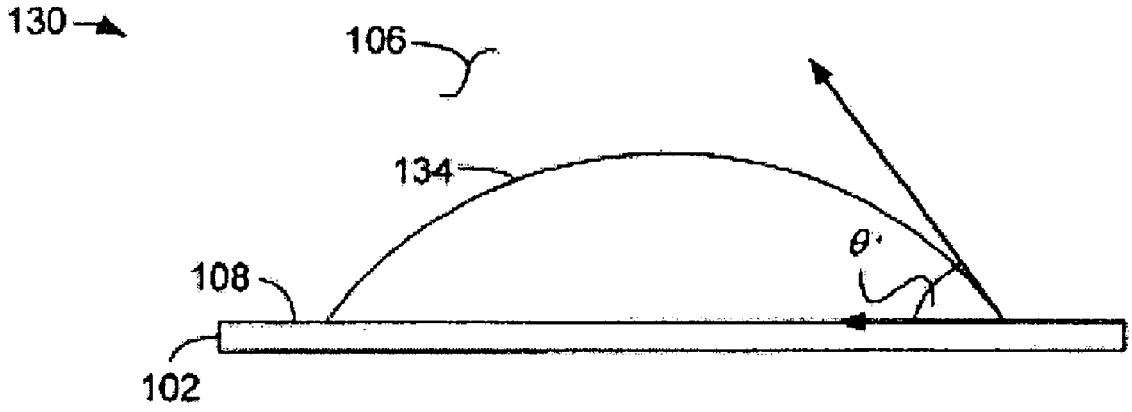
FIG. 1B is a schematic diagram illustrating the system of FIG. 1A having a different contact angle.

FIG. 1B is a schematic diagram 130 illustrating the system 100 of FIG. 1A having a different contact angle. In FIG. 1B, the droplet 134 is more wettable with respect to the surface 108 than the droplet 104 with respect to the surface 108, and therefore forms a lower contact angle, referred to as θ. As shown in FIG. 1B, the droplet 134 is flatter and has a lower profile than the droplet 104 of FIG. 1A. The concept of electrowetting, which is defined as a change in contact angle with the application of an electrical potential, relies on the ability to electrically alter the contact angle that a conductive liquid forms with respect to a surface with which the conductive liquid is in contact. In general, the contact angle between a conductive liquid and a surface with which it is in contact ranges between 0° and 180°. Another theory of electrowetting focuses on the motion of the center of mass of the liquid of interest, with the force defined as change in energy (capacitive) of the system, with respect to the displacement of the liquid. Contact angle changes are not directly addressed in this analysis.

Figure 2A:
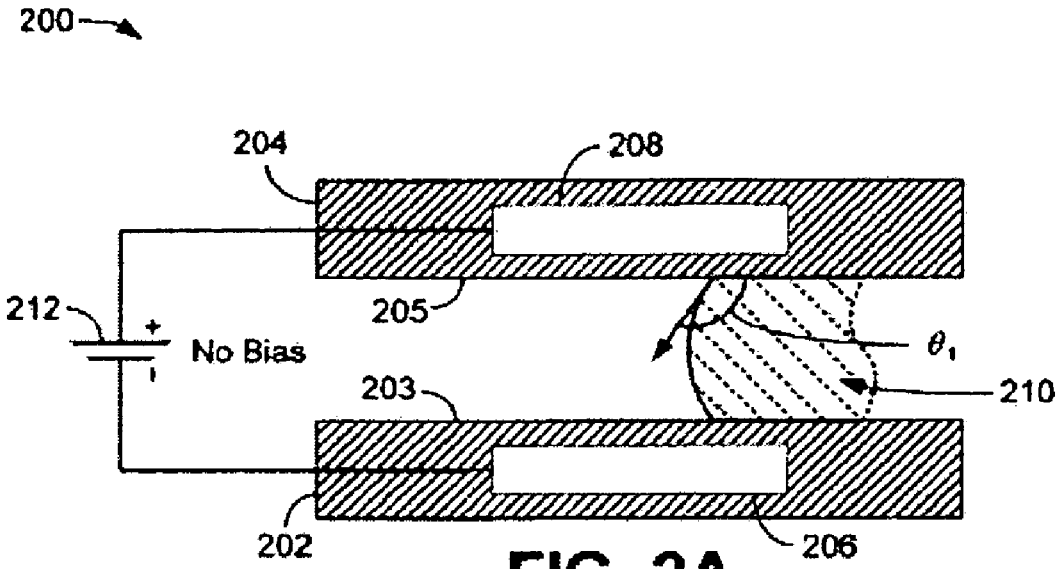
FIG. 2A is a schematic diagram illustrating one manner in which electrowetting can alter the contact angle between a droplet of conductive liquid and a surface that it contacts.

FIG. 2A is a schematic diagram 200 illustrating one manner in which electrowetting can alter the contact angle between a droplet of conductive liquid and a surface that the droplet contacts. In FIG. 2A, a droplet 210 of conductive liquid is sandwiched between dielectric 202 and dielectric 204. The dielectric can be, for example, tantalum oxide, or another dielectric material. An electrode 206 is buried within dielectric 202 and an electrode 208 is buried within dielectric 204. The electrodes 206 and 208 are coupled to a voltage source 212. In FIG. 2A, the system is electrically non-biased. Under this non-bias condition, the droplet 210 forms a contact angle, referred to as $\theta_1$, with respect to the surface 205 of the dielectric 204 that is in contact with the droplet 210. A similar contact angle exists between the droplet 210 and the surface 203 of the dielectric 202.

Figure 2B:
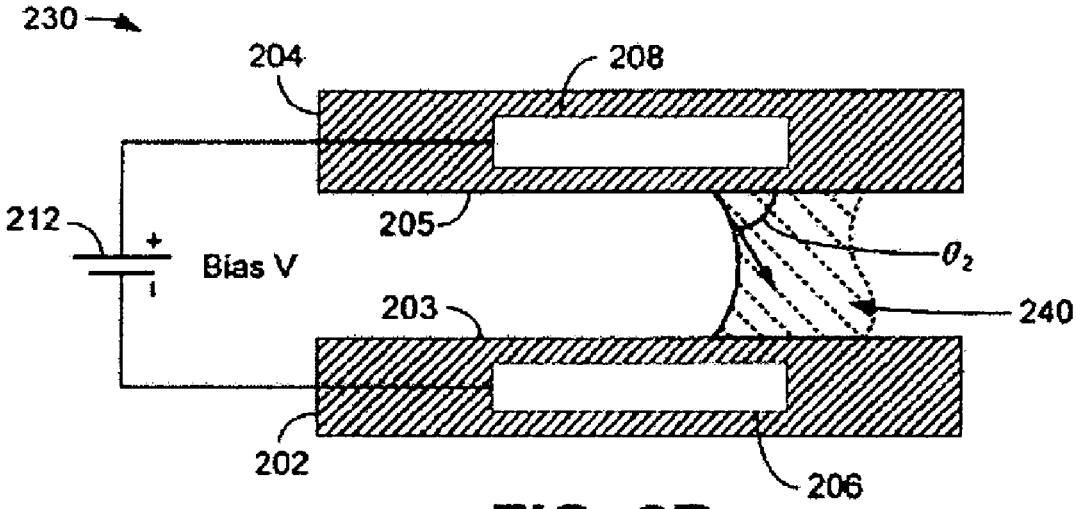
FIG. 2B is a schematic diagram illustrating the system of FIG. 2A under an electrical bias.

FIG. 2B is a schematic diagram 230 illustrating the system 200 of FIG. 2A under an electrical bias. The voltage source 212 provides a bias voltage to the electrodes 206 and 208. The voltage applied to the electrodes 206 and 208 creates an electric field through the conductive liquid droplet causing the droplet to move. The movement of the droplet 210 increases the capacitance of the system, thus increasing the energy of the system. In this example, the contact angle of the droplet 240 is altered with respect to the contact angle of the droplet 210. The new contact angle is referred to as $\theta_2$, and is a result of the electric field created between the electrodes 206 and 208 and the droplet 240.

It is typically desirable to isolate the droplet from the electrodes, and thus allow the droplet to become part of a capacitive circuit. The application of an electrical bias as shown in FIG. 2B, makes the surface 205 of the dielectric 204 and the surface 205 of the dielectric 202 more wettable with respect to the droplet 240 than the no-bias condition shown in FIG. 2A. Although the surface tension of the liquid that forms the droplet 240 resists the electrowetting effect, the contact angle changes as a result of the creation of the electric field between the electrodes 206 and 208. As will be described below, the change in the contact angle alters the curvature of the droplet and leads to translational movement of the droplet.

Figure 3A:
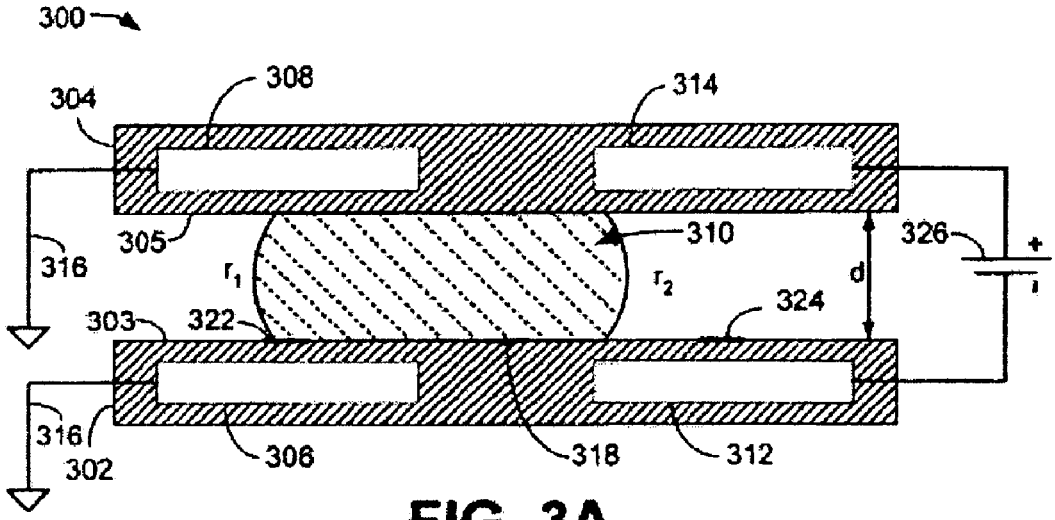
FIG. 3A is a schematic diagram illustrating an embodiment of an electrical switch employing a conductive liquid droplet.

FIG. 3A is a schematic diagram illustrating an embodiment of an electrical switch 300 employing a conductive liquid droplet. The switch 300 includes a dielectric 302 having a surface 303 forming the floor of the switch, and a dielectric 304 having a surface 305 that forms the roof of the switch. A droplet 310 of a conductive liquid is sandwiched between the dielectric 302 and the dielectric 304. The dielectric 302 includes an electrode 306 and an electrode 312. The dielectric 304 includes an electrode 308 and an electrode 314. The electrodes 306 and 312 are buried within the dielectric 302 and the electrodes 308 and 314 are buried within the dielectric 304. In this example, and to induce the droplet 310 to move toward the electrodes 312 and 314, the electrodes 306 and 308 are coupled to an electrical return path 316 and are electrically isolated from electrodes 312 and 314, and the electrodes 312 and 314 are coupled to a voltage source 326. Alternatively, to induce the droplet 310 to move toward the electrodes 306 and 308, the electrodes 312 and 314 can be coupled to an isolated electrical return path and the electrodes 306 and 308 can be coupled to a voltage source.

In this example, the switch 300 includes electrical contacts 318, 322, and 324 positioned on the surface 303 of the dielectric 302. In this example, the contact 318 can be referred to as an input, and the contacts 322 and 324 can be referred to as outputs. As shown in FIG. 3A, the droplet 310 is in electrical contact with the input contact 318 and the output contact 322. Further, in this example, the droplet 310 will always be in contact with the input contact 318.

As shown in FIG. 3A as a cross section, the droplet 310 includes a first radius, $r_1$, and a second radius, $r_2$. When electrically unbiased, i.e., when there is zero voltage supplied by the voltage source 326, the curvature of the radius r, equals the curvature of the radius $r_2$ and the droplet is at rest. The radius of curvature, r, of the droplet is defined as $$r = \frac{d}{\cos\theta_{top} + \cos\theta_{bottom}} \quad \text{Eq. 1}$$

where d is the distance between the surface 303 of the dielectric 302 and the surface 305 of the dielectric 304, $\theta_{top}$ is the contact angle between the droplet 310 and the surface 305, and $\theta_{bottom}$ is the contact angle between the droplet 310 and the surface 303. Therefore, as shown in FIG. 3A, the droplet 310 is at rest whereby the radius $r_1$ equals the radius $r_2$, where the curvatures are in opposing directions. Upon application of an electrical potential via the voltage source 326, a new contact angle between the droplet 310 and the surfaces 303 and 305 is defined. The following equation defines the new contact angle.

$$\cos\theta(V) = \cos\theta_o + \frac{\varepsilon}{2\gamma t}V^2 \quad \text{Eq. 2}$$

Equation 2 is referred to as Young-Lippmann Equation, where the new contact angle, θ(V), is determined as a function of the applied voltage. In equation 2, $\theta_0$ is the contact angle with no voltage applied, ϵ is the dielectric constant of the dielectrics 302 and 304, γ is the surface tension of the liquid, t is the dielectric thickness, and V is the voltage applied to the electrode with respect to the conductive liquid. Therefore, to change the contact angle of the droplet 310 with respect to the surfaces 303 and 305 a voltage is applied to electrodes 314 and 312, thus altering the profile of the droplet 310 so that $r_1$ is not equal to $r_2$. If $r_1$ is not equal to $r_2$, then the pressure, P, on the droplet 310 changes according to the following equation.

$$P = \gamma\left(\frac{1}{r_1} + \frac{1}{r_2}\right) \quad \text{Eq. 3}$$

Figure 3B:
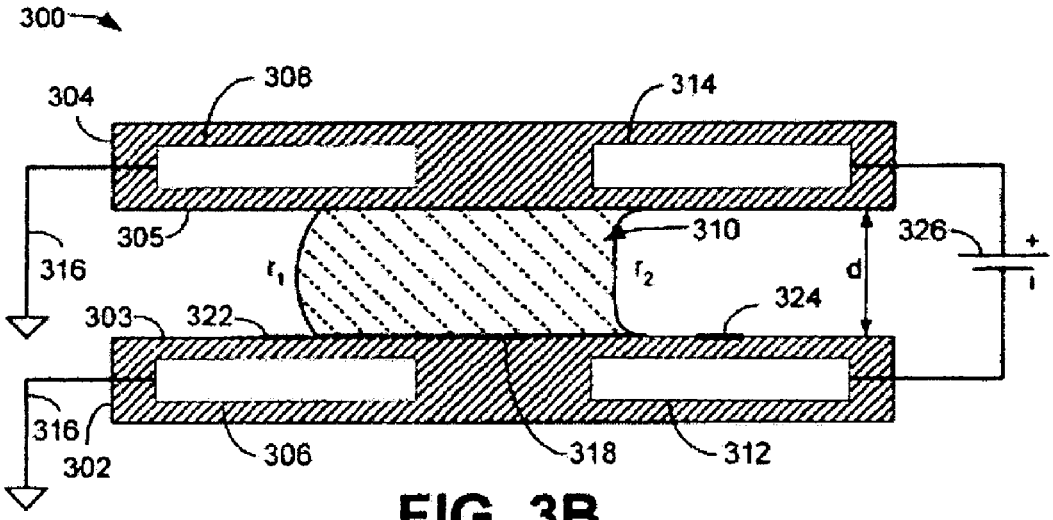
FIG. 3B is a schematic diagram illustrating the movement imparted to a droplet of conductive liquid as a result of the change in contact angle due to electrowetting.

FIG. 3B is a schematic diagram illustrating the movement imparted to a droplet of conductive liquid as a result of the pressure change of the droplet 310 caused by the reduction in contact angle due to electrowetting. When a voltage is applied to the electrodes 314 and 312 by the voltage source 326, the contact angle of the droplet 310 with respect to the surfaces 303 and 305 in FIG. 3A is reduced so that $r_1$ does not equal $r_2$. When the radii $r_1$ and $r_2$ differ, a pressure differential is induced across the droplet, thus causing the droplet to translate across the surfaces 303 and 305.

Figure 3C:
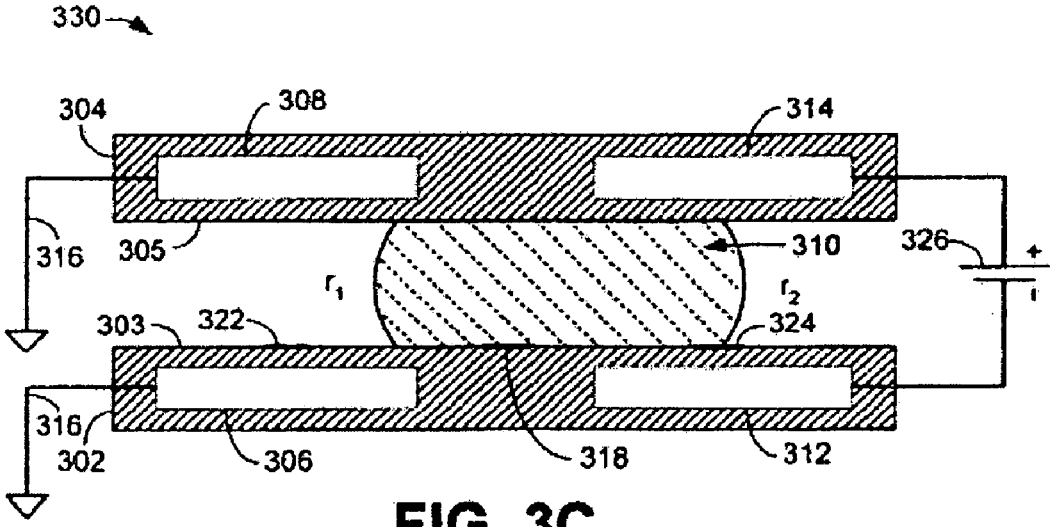
FIG. 3C is a schematic diagram illustrating the switch of FIG. 3A after the application of an electrical potential.

FIG. 3C is a schematic diagram 330 illustrating the switch 300 of FIG. 3A after the application of a voltage. As shown in FIG. 3C, the droplet 310 has moved and now electrically connects the input contact 318 and the output contact 324. In this manner, electrowetting can be used to induce translational movement in a conductive liquid and can be used to switch electronic signals.

Figure 4A:
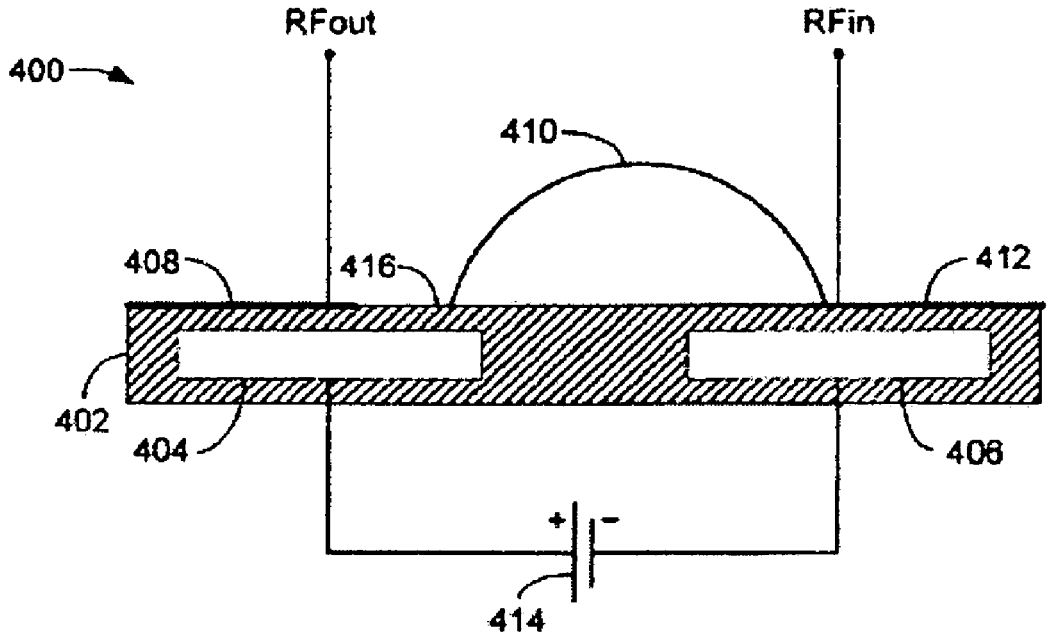
FIG. 4A is a schematic diagram illustrating the cross-section of a switch according to a first embodiment of the invention.

FIG. 4A is a schematic diagram illustrating a cross-section of a switch according to a first embodiment of the invention. In a switch 400, a droplet 410 of a conductive liquid that contacts only one surface is referred to as a "sessile" droplet. The sessile droplet 410 rests on a surface 416 of a dielectric 402. The dielectric can be, for example, tantalum oxide and the droplet 410 can be mercury, a gallium alloy, or another conductive liquid. An input contact 412, referred to in this embodiment as radio frequency input (RF in) contact and an output contact 408, RF out, are formed on the surface 416 of the dielectric 402. The droplet 410 is in electrical contact with the input contact 412. The surface 416 of the dielectric 402 is also at least partially covered with one or more features that influence the contact angle formed by the droplet 410 with respect to the surface 416. Examples of features that influence the contact angle formed by the droplet 410 with respect to the surface 416 include the type of material that covers the surface 416, the patterning of a wetting material formed over a non-wetting surface, and microtexturing to alter the wettability of portions of the surface 416, etc. These features will be described below.

The dielectric 402 also includes an electrode 404 and an electrode 406 coupled to a voltage source 414. The electrodes 404 and 406 are buried within the dielectric 402. With no electrical bias, the droplet 410 conforms to a prespecified shape that can be determined by controlling the contact angle between the surface 416 and the droplet 410, as mentioned above. While the droplet 410 is located over the electrodes 404 and 406, it should be understood that the term "over" is meant to describe a spatially invariant relative relationship between the droplet 410 and the electrodes 404 and 406. Moreover, the droplet 410 is located proximate to the electrodes 404 and 406 so that if the switch 400 were inverted, the droplet 410 would still be proximate to the electrodes 404 and 406 as shown. Further, the relationship between the droplet and the electrodes in the embodiments to follow is similarly spatially invariant.

Figure 4B:
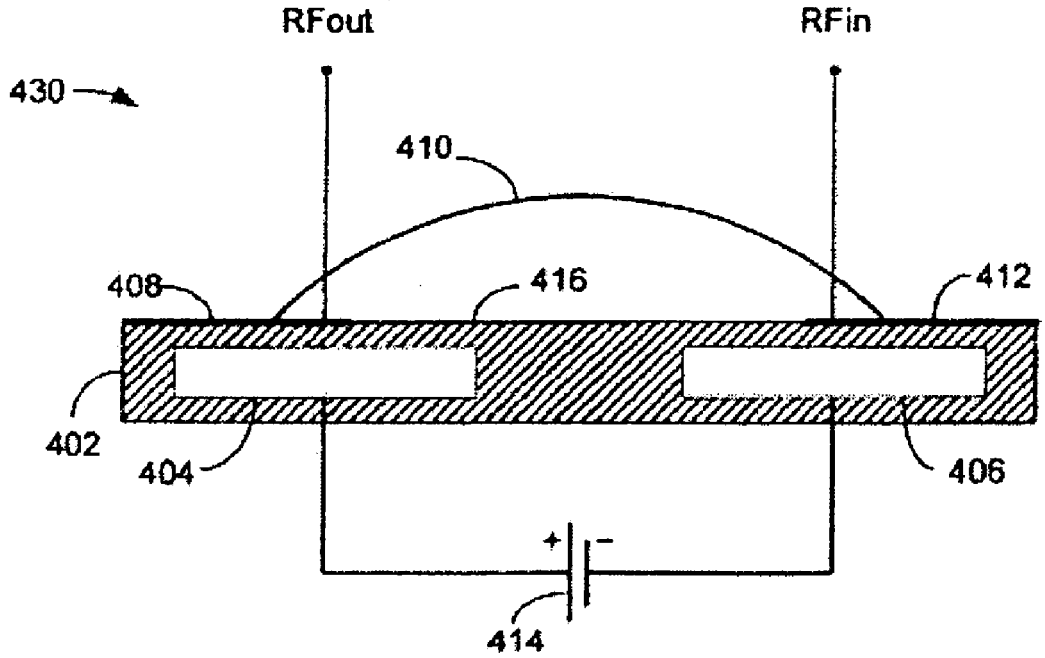
FIG. 4B is a schematic diagram illustrating the switch of FIG. 4A under an electrical bias.

FIG. 4B is a schematic diagram illustrating the switch 400 of FIG. 4A under an electrical bias. In FIG. 4B, an electrical bias is applied by the voltage source 414 to the electrodes 404 and 406. The electrical bias establishes an electric field that passes through the droplet 410, thus causing the droplet 410 to deform as shown in FIG. 4B. The applied bias alters the contact angle between the droplet 410 and the surface 416, thus causing the droplet to flatten and overlap both contacts 412 and 408. In this manner, a simple switch is formed that uses electrowetting of the droplet 410 to make and break electrical contact between the input contact 412 and the output contact 408.

When an electrical bias is applied to the electrodes 404 and 406, the droplet completes a capacitive circuit between the electrodes 404 and 406 and if the dielectric is of constant thickness, the applied voltage is evenly distributed causing the same change in contact angle of the droplet 410 over both electrodes 404 and 406. In this example, when the bias is removed, the droplet 410 will return to its original state as shown in FIG. 4A, and break contact with the output electrode 408. The embodiment shown in FIGS. 4A and 4B is referred to as a "non-latching" switch in that the droplet returns to its original state when the bias voltage is removed, thus breaking electrical contact between the input contact 412 and the output contact 408.

Figure 4C:
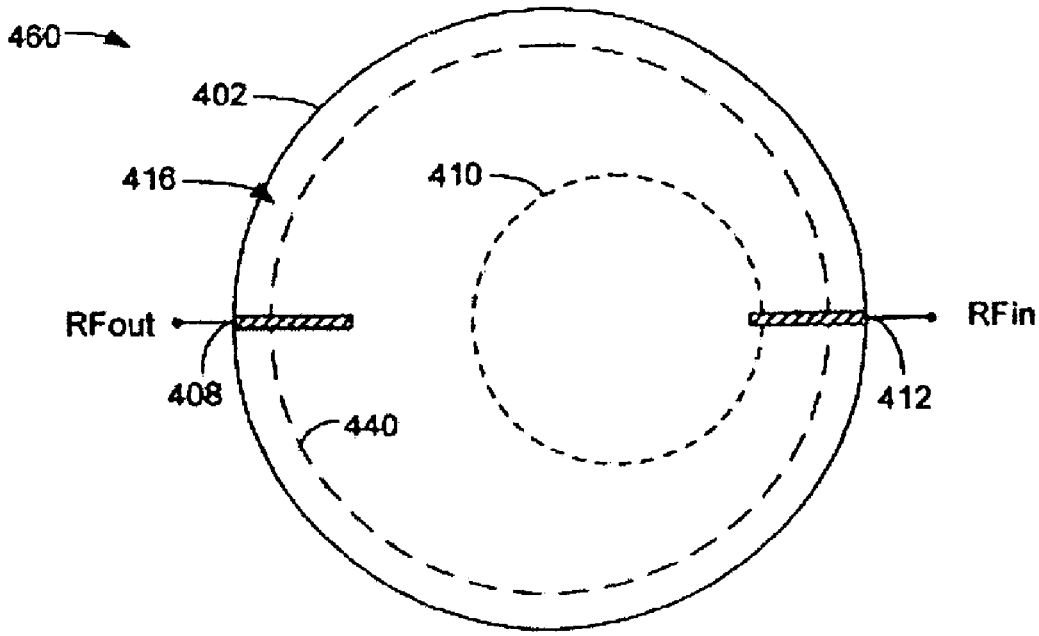
FIG. 4C is a plan view illustrating the switch shown in FIGS. 4A and 4B.

FIG. 4C is a plan view 460 illustrating the switch shown in FIGS. 4A and 4B. The droplet 410 under no electrical bias is shown in contact only with the input contact 412, while the droplet 440, which is under an electrical bias, is shown in contact with the input contact 412 and the output contact 408.

Figure 4D:
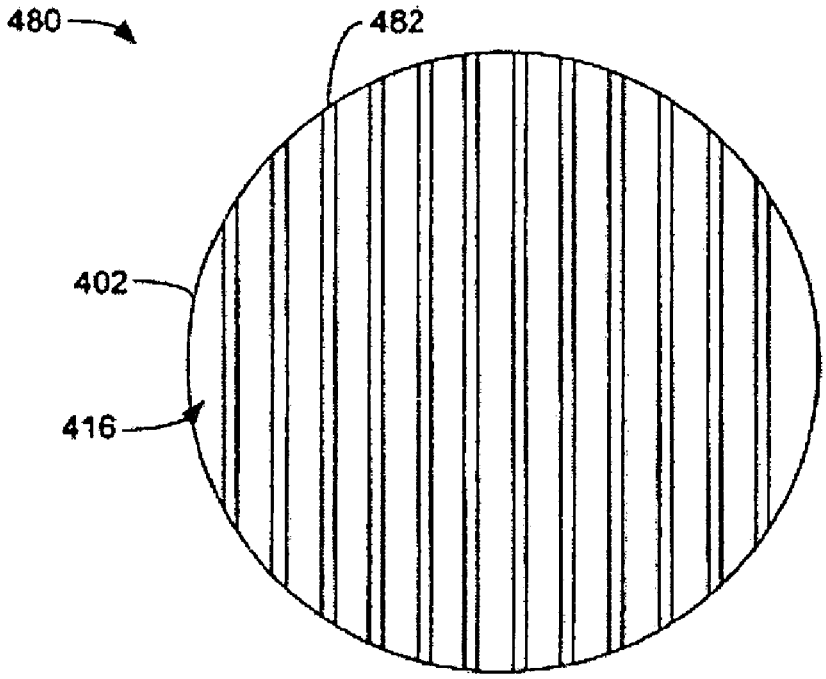
FIG. 4D is a plan view illustrating the surface of the dielectric including a feature that alters the wettability of the surface with respect to the droplet.

FIG. 4D is a plan view 480 illustrating the surface 416 of the dielectric 402 including a feature that alters the wettability of the surface with respect to the droplet. In this example, the surface 416 of the dielectric 402 is silicon dioxide ($SiO_2$) to which strips of a wetting material 482 have been applied to alter the initial contact angle between the droplet 410 and the surface 416, thus forming an intermediate contact angle for the droplet 410. In this example, the wetting material 482 is gold (Au). Alternatively, wetting materials other than gold can be applied, forming other contact angles between the surface 416 and the droplet 410. Further, microtexturing, which is the formation of small trenches in the surface 416 can also be applied to alter the contact angle between the surface 416 and the droplet 410. In this manner, an initial contact angle can be established between the surface 416 and the droplet 410. By defining an initial contact angle, the contact angle change due to the application of an electrical bias can be closely controlled, thereby allowing control over the switching function.

Figure 5A:
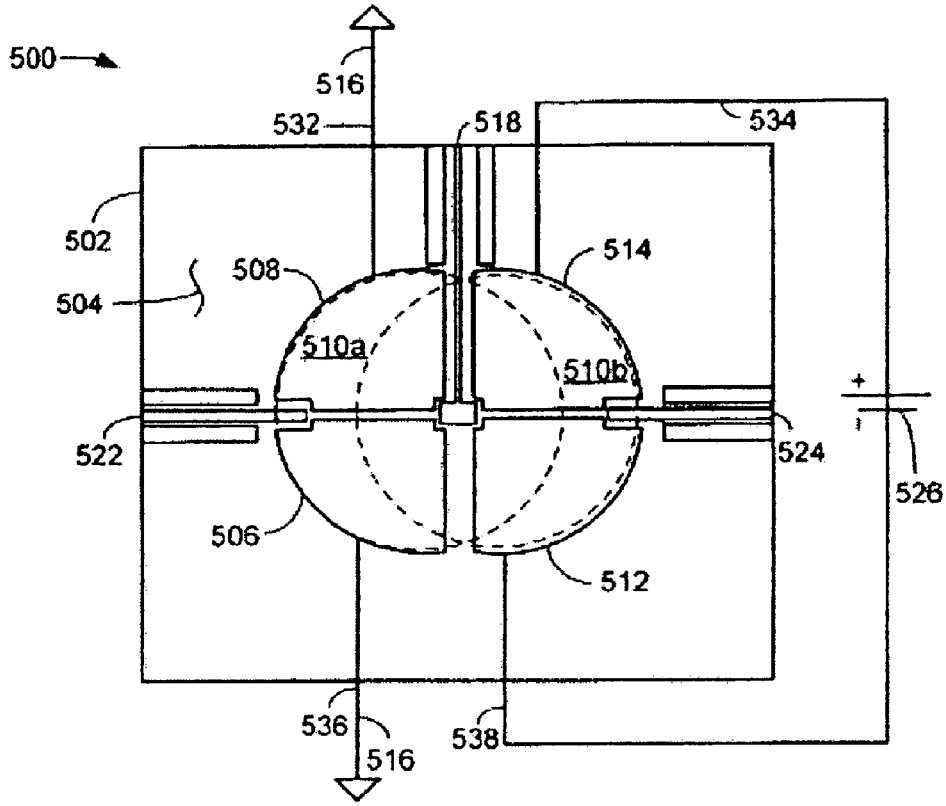
FIG. 5A is a plan view illustrating a second embodiment of a switch according to the invention.

FIG. 5A is a plan view illustrating a second embodiment 500 of a switch according to the invention. FIG. 5A shows a switch 500 including a sessile droplet 510 residing on the surface 504 of a dielectric 502. Electrodes 506, 508, 512 and 514 are formed below the surface 504 of the dielectric 502. The droplet 510 is shown in a first position 510*a* in contact with an input contact 518 and with an output contact 522, and is shown in a second position 510*b* in contact with the input contact 518 and the output contact 524.

The electrode 508 is coupled via connection 532 to electrical return path 516 and the electrode 506 is connected via connection 536 to electrical return path 516. The electrodes 512 and 514 are coupled via connection 538 and 534 to voltage source 526 and are electrically isolated from electrodes 506 and 508. In this embodiment, when electrically biased, the electrical connections will induce the droplet to move toward the electrodes 512 and 514. Alternatively, to induce the droplet to move toward the electrodes 506 and 508, the electrodes 512 and 514 can be coupled to the electrical return path 516 and the electrodes 506 and 508 can be coupled to a voltage source.

Upon the application of a bias voltage, the sessile droplet 510 will translate from the position shown as 510*a* to the position shown as 510*b*. This embodiment is referred to as a "latching" embodiment in that the position of the droplet 510 remains fixed until a bias voltage is applied to cause the droplet to translate. In this example, by controlling the voltage applied to electrodes 512 and 514 and electrodes 506 and 508, the droplet 510 is toggled to provide a switching function. With no electrical bias applied, the droplet 510 is confined to a specific area, shown in outline as 510*a*, by tailoring an initial contact angle between the droplet and the surface 504. By selecting the material of the droplet 510 and the material applied over the surface 504 to define the wettability between the droplet 510 and the surface 504, it is possible to tailor the initial contact angle to ensure latching of the droplet 510.

Figure 5B:
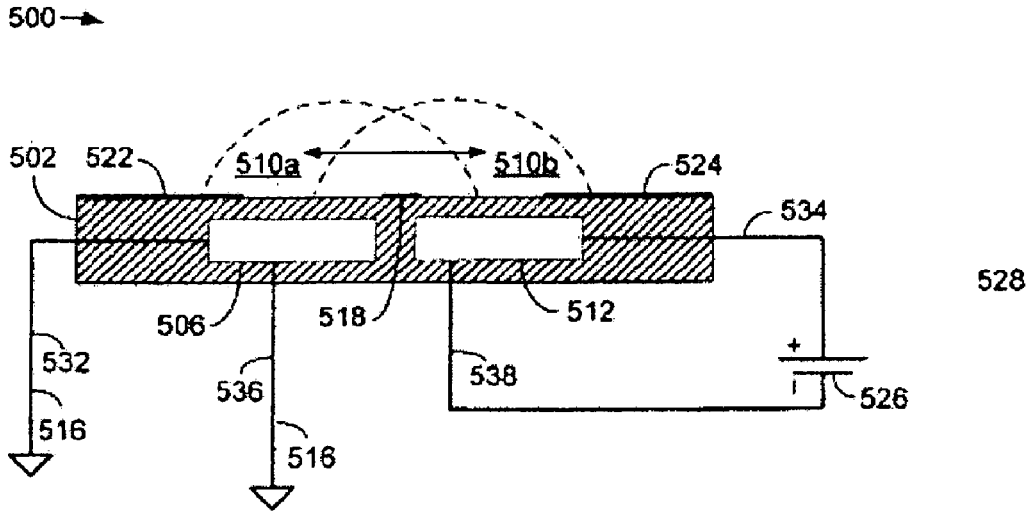
FIG. 5B is a cross-sectional view illustrating the switch of FIG. 5A.

FIG. 5B is a cross-sectional view illustrating the switch 500 of FIG. 5A. The switch 500 includes a droplet 510 resting on the surface 504 of the dielectric 502. Depending upon the bias voltage applied by the voltage source 526 to the electrodes 512 and 514, the droplet 510 will translate between position 510*a* and 510*b*, thus switching a signal from the input contact 518 to either the output contact 522 or the output contact 524.

Figure 6A:
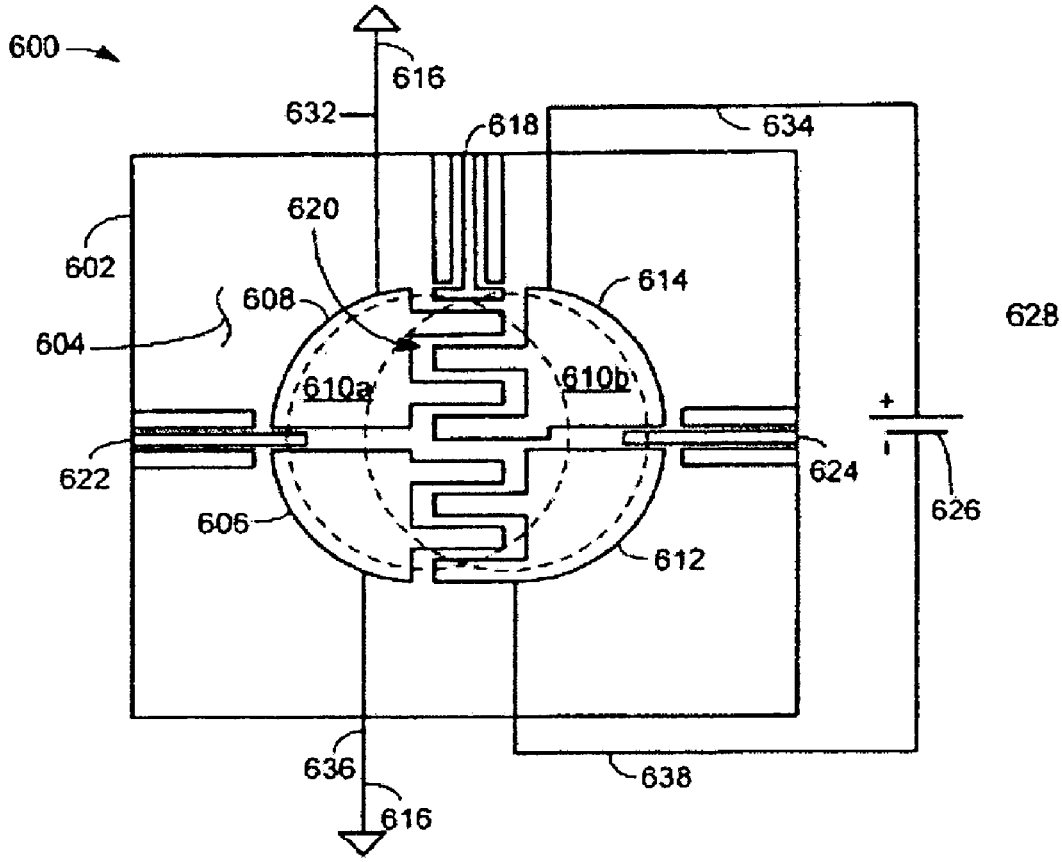
FIG. 6A is an alternative embodiment of the switch shown in FIG. 5A.

FIG. 6A is an alternative embodiment 600 of the switch 500 shown in FIG. 5A. In FIG. 6A, the electrodes 606 and 612 include interleaved contacts, and the electrodes 608 and 614 include interleaved contacts, collectively referred to at 620. The application of a bias voltage from the voltage source 626 causes the droplet 610 to translate from position 610*a* to position 610*b*, thus causing an input signal applied to input contact 618 to be directed either to output contact 622 or to output contact 624, depending on the position of the droplet 610.

Figure 6B:
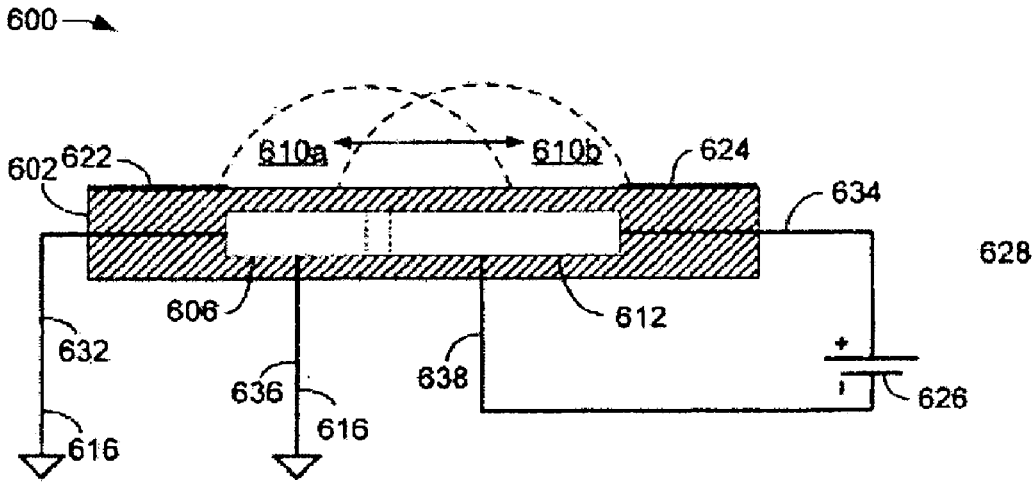
FIG. 6B is a cross-sectional view illustrating the switch of FIG. 6A.

FIG. 6B is a cross-sectional view illustrating the switch 600 of FIG. 6A. By controlling the voltage applied to electrodes 612 and 614 and electrodes 606 and 608 the droplet 610 will translate between positions 610*a* and 610*b*, thus causing an input signal applied to input contact 618 to be directed either towards output contact 622 or output contact 624, depending on the position of the droplet 610.

Figure 7:
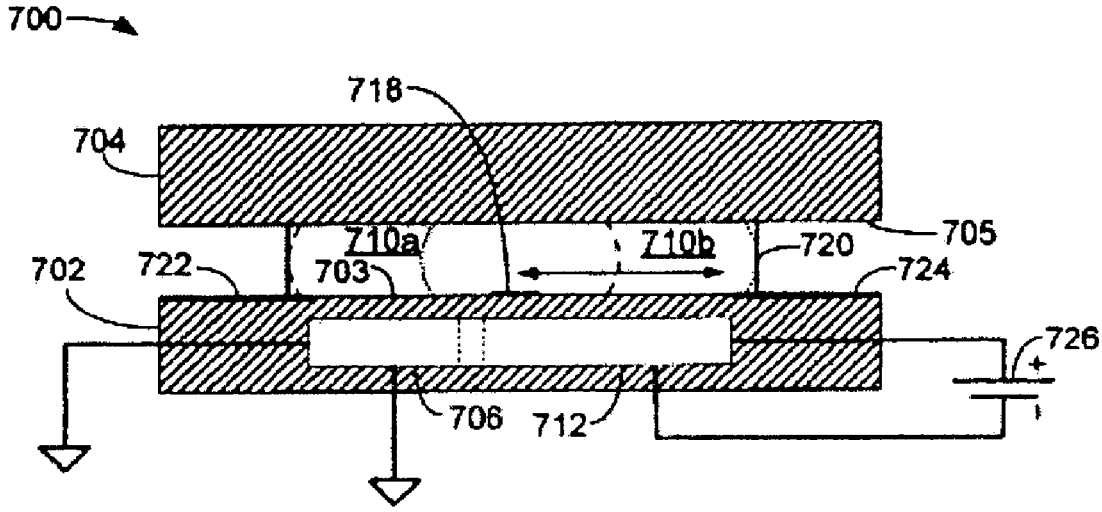
FIG. 7 is a schematic diagram illustrating another alternative embodiment of a switch according to the invention.

FIG. 7 is a schematic diagram 700 illustrating another alternative embodiment of a switch according to the invention. The switch 700 illustrates what is referred to as a "fully constrained" configuration in that a droplet 710 is constrained between a dielectric 702 having a surface 703, a dielectric 704 having a surface 705, and a microfluidic boundary 720 between the dielectric 702 and the dielectric 704. The microfluidic boundary forms a cavity to contain the droplet 710. While the microfluidic boundary 720 is illustrated as a separate element in FIG. 7, the microfluidic boundary 720 may be incorporated into a structure including the dielectric 704 and/or the dielectric 702.

The dielectric 702 includes an electrode arrangement similar to the electrode arrangement shown in FIGS. 5A, 5B or FIGS. 6A and 6B. However, only electrodes 706 and 712 are shown in FIG. 7.

A bias voltage applied from voltage source 726 causes the droplet 710 to translate between position 710*a* and 710*b*, thus creating a switching function. In this embodiment, upon the application of a bias voltage, the contact angle between the droplet 710 and the surface 703 will change, leading to translation of the droplet across the surfaces 703 and 705.

Figure 8:
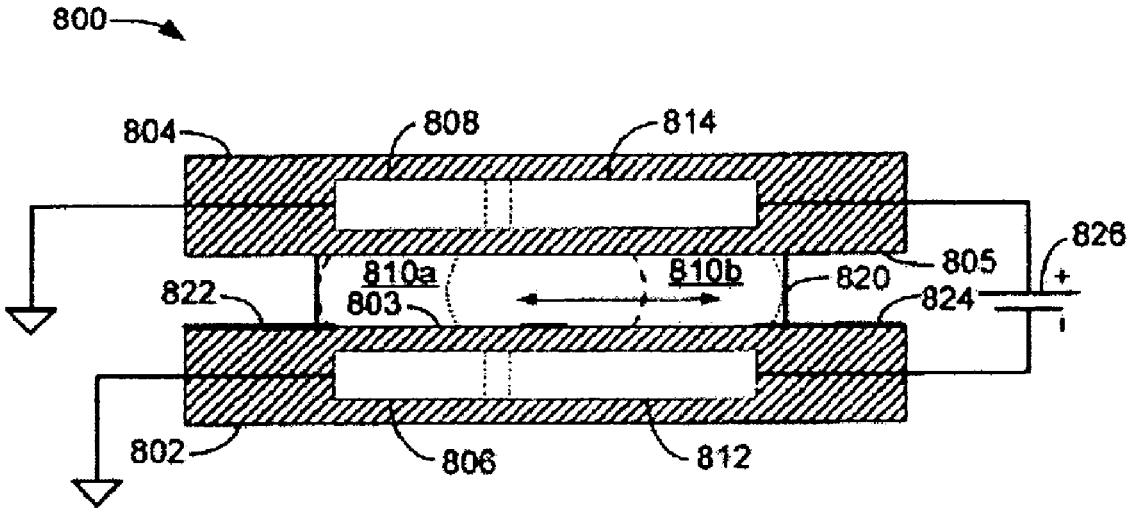
FIG. 8 is a schematic diagram illustrating an alternative embodiment of the switch shown in FIG. 7.

FIG. 8 is a schematic diagram 800 illustrating an alternative embodiment of the switch 700 shown in FIG. 7. In FIG. 8, the dielectric 804 includes electrodes 808 and 814. The electrodes 808 and 814 can be arranged as described in FIGS. 5A and 5B, or can be interleaved as described above in FIGS. 6A and 6B. The surface 803, the surface 805 and a microfluidic boundary 820 form a cavity that constrains the droplet so that it may translate between positions 810*a* and 810*b* upon application of a bias voltage from voltage source 826. In this embodiment, upon the application of a bias voltage, the contact angle between the droplet 810 and the surfaces 803 and 805 will change, leading to translation of the droplet across the surfaces 803 and 805.

Figure 9:
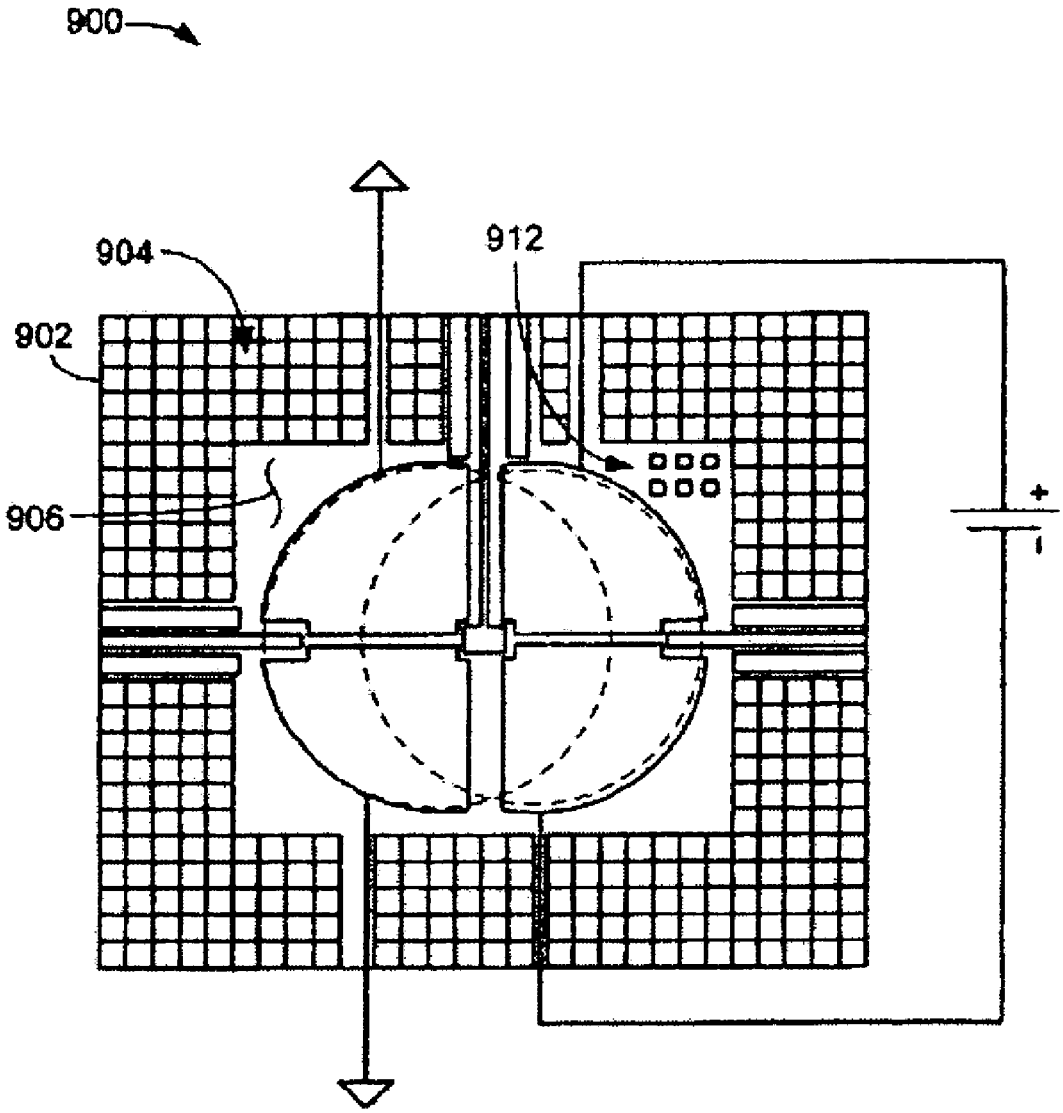
FIG. 9 is a schematic diagram illustrating surface texturing that can be applied to the switch of FIGS. 5A and 5B.

FIG. 9 is a schematic diagram 900 illustrating surface texturing that can be applied to any of the switches described herein. The surface texturing described in FIG. 9 can be applied to any of the embodiments of the switch described above to alter the initial contact angle between a droplet and a surface with which the droplet is in contact. The dielectric 902 includes a non-wetting pattern 904 applied approximately as shown, thus leaving a wetting pattern 906 over which the droplet will reside. In addition, the wetting pattern 906 can be further defined to include non-wetting portions 912 to finely tailor an initial contact angle between the droplet and the surface with which the droplet is in contact. In this manner, the initial contact angle can be tailored to suit particular applications.

Figure 10:
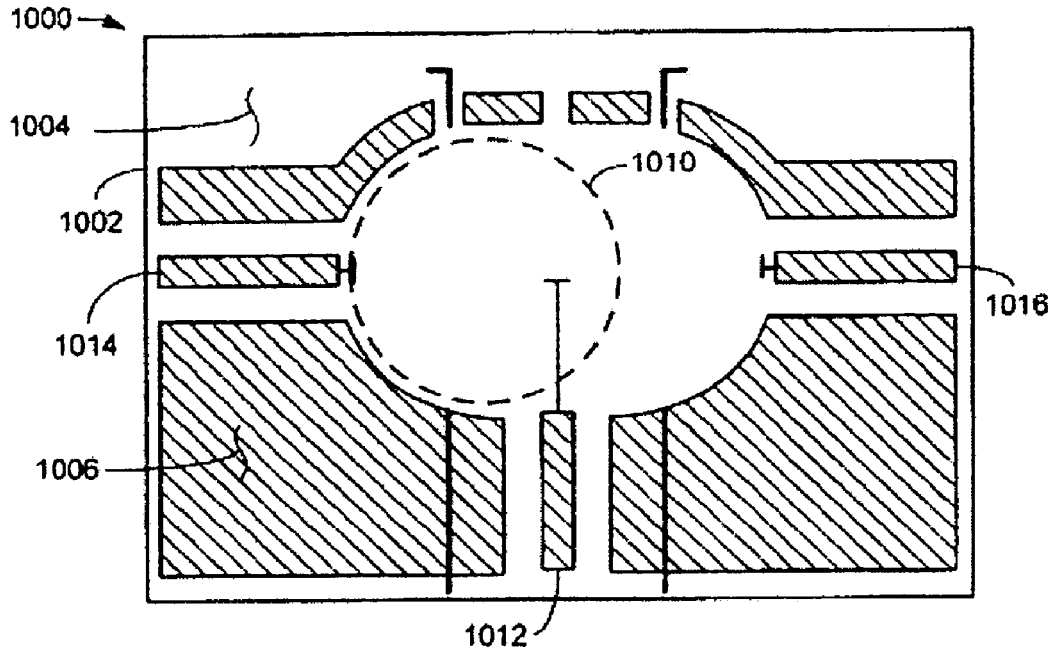
FIG. 10 is a schematic diagram illustrating an exemplary dielectric substrate that may form the lower surface, or floor, of a switch described above.

FIG. 10 is a schematic diagram 1000 illustrating an exemplary dielectric substrate that may form the lower surface, or floor, of a switch described above. In this example, a silicon substrate 1002 includes a patterning of metal thin film material shown generally as locations indicated at 1006 over the surface 1004 that forms a floor. In this example, the dielectric film that would be applied over the metal film is omitted for clarity. An approximate location of the droplet is shown at 1010. The input contact is shown at 1012 and the output contacts are shown at 1014 and 1016.

Figure 11:
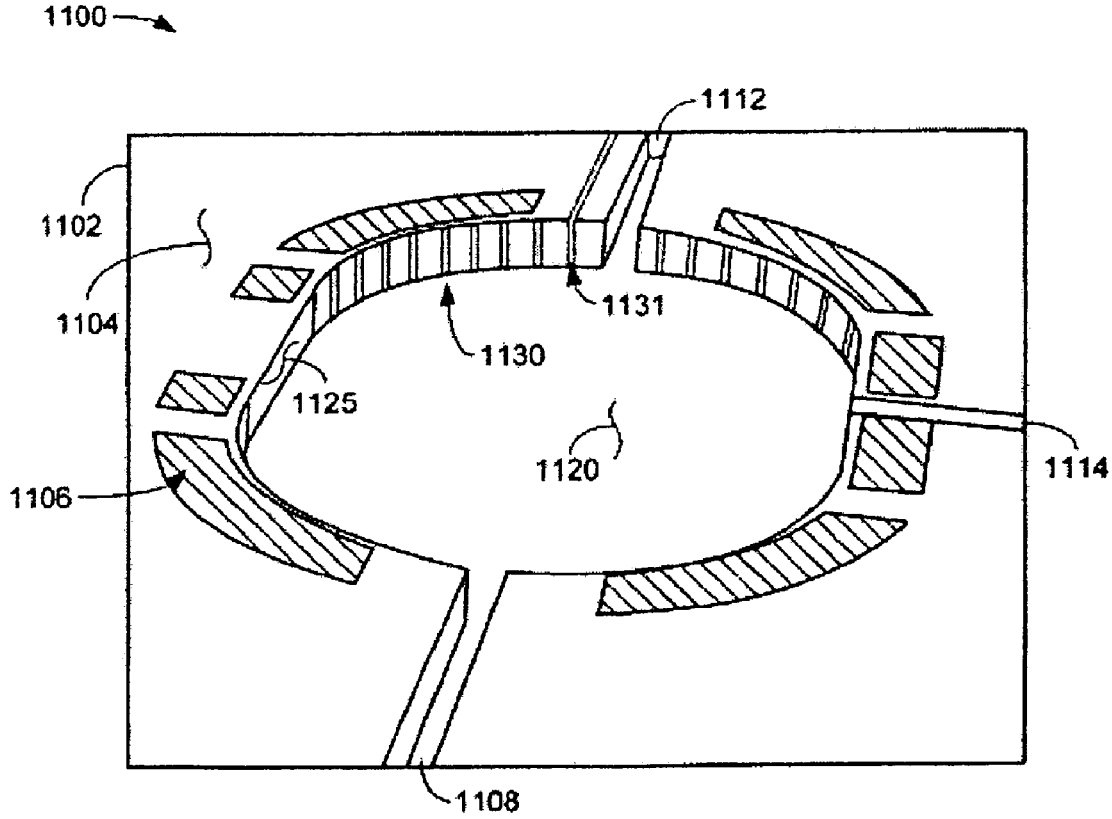
FIG. 11 is a perspective view illustrating a cap that forms the roof and microfluidic chamber of a switch of FIG. 7, 8 or 9.

FIG. 11 is a perspective view 1100 illustrating a cap 1102 that forms the roof and microfluidic chamber of a switch of FIG. 7, 8 or 9. In this example, the cap 1102 can be fabricated from, for example, a glass material such as Pyrex®, the underside 1104 of which is shown in FIG. 11. The cap 1102 includes a roof portion 1120 and a wall portion 1125 that forms the microfluidic boundary described above. Portions of a metal thin film illustrated at 1106 can be selectively applied to the surface 1104 to correspond at least partially with the portions 1006 of FIG. 10 so that the cap 1102 can be bonded to the substrate 1002 shown in FIG. 10. For example, in places where the metal thin film 1006 of FIG. 10 contacts the metal thin film 1106 of FIG. 11, a thermal compression bond using heat and pressure can be achieved, thus forming a structure that can encapsulate a droplet. Alternatively, anodic bonding can be used to bond the substrate 1002 (FIG. 10) to the cap 1102. In this manner, a microfluidic chamber can be formed within which the droplet described above may reside. Electrodes may be embedded into or applied to the roof portion 1120.

The wall 1125 of the cap 1102 can also include one or more features to alter wetting and latching ability of a switch. Such a feature is shown at 1130 and can be, for example, openings that might be vented to a reference reservoir (not shown). When the openings 1130 are sufficiently small, the liquid metal will not wick through, provided the walls are relatively non-wetting, but will remain in the chamber formed by the roof portion 1120, the wall 1125, and the floor surface 1004 (FIG. 10). The adhesion energy between the droplet and the wall 1125 will be reduced by the openings 1130. Selectively defining the openings 1130 to control the adhesion energy can control the latching strength of the switch. The cap 1102 also includes a fill port 1114, through which the conductive liquid may be introduced, and vent ports 1108 and 1112.

Figure 12:
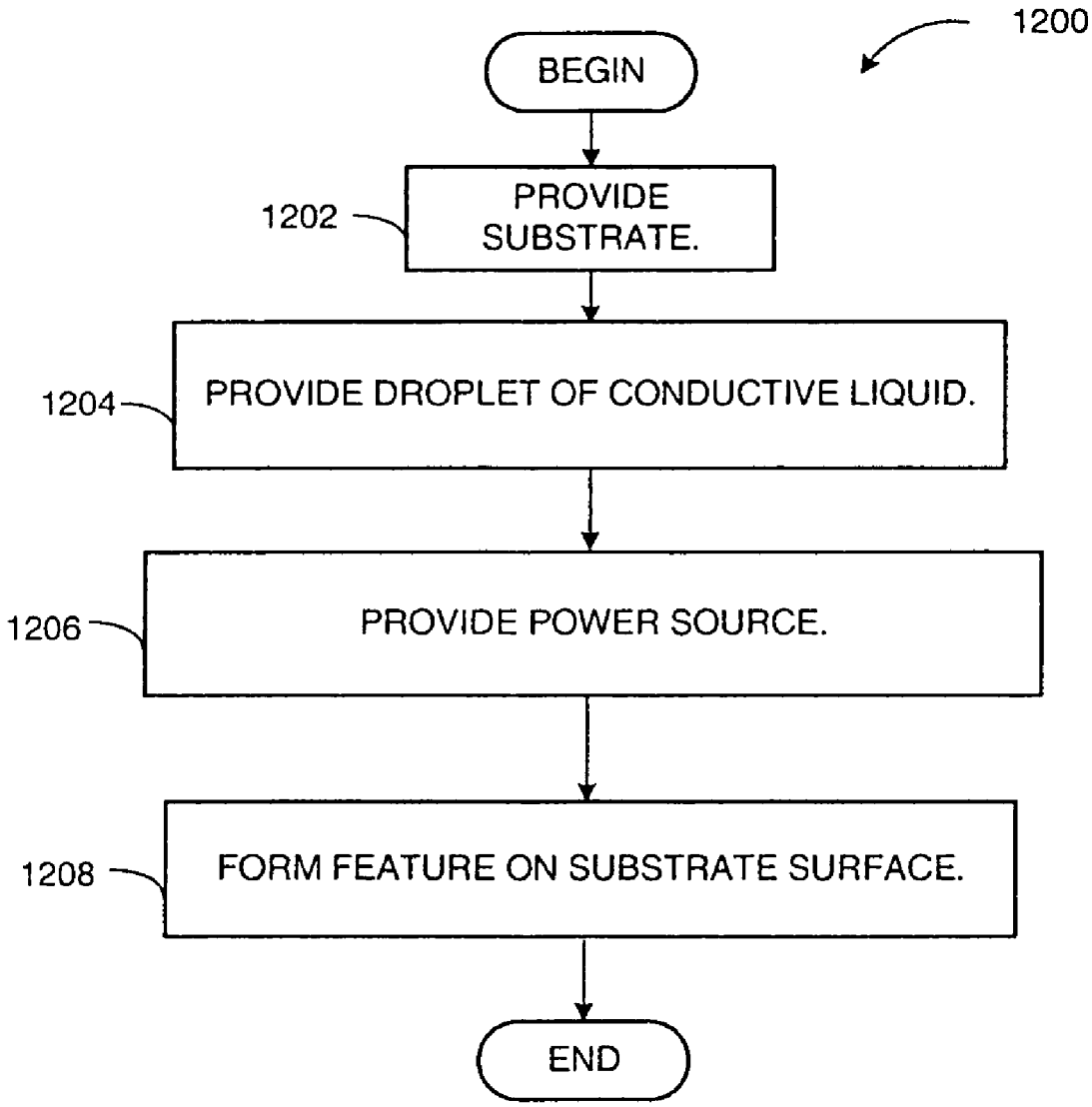
FIG. 12 is a flowchart describing a method of forming a switch according to an embodiment of the invention.

FIG. 12 is a flowchart 1200 describing a method of forming a switch according to an embodiment of the invention. In block 1202 a substrate including buried electrodes is provided. In block 1204 a droplet of conductive liquid is provided over the substrate. In block 1206, a power source configured to create an electric circuit including the droplet of conductive liquid is provided. In block 1208 a feature is formed on the surface. The feature determines an initial contact angle between the surface and the droplet.

Figure 13:
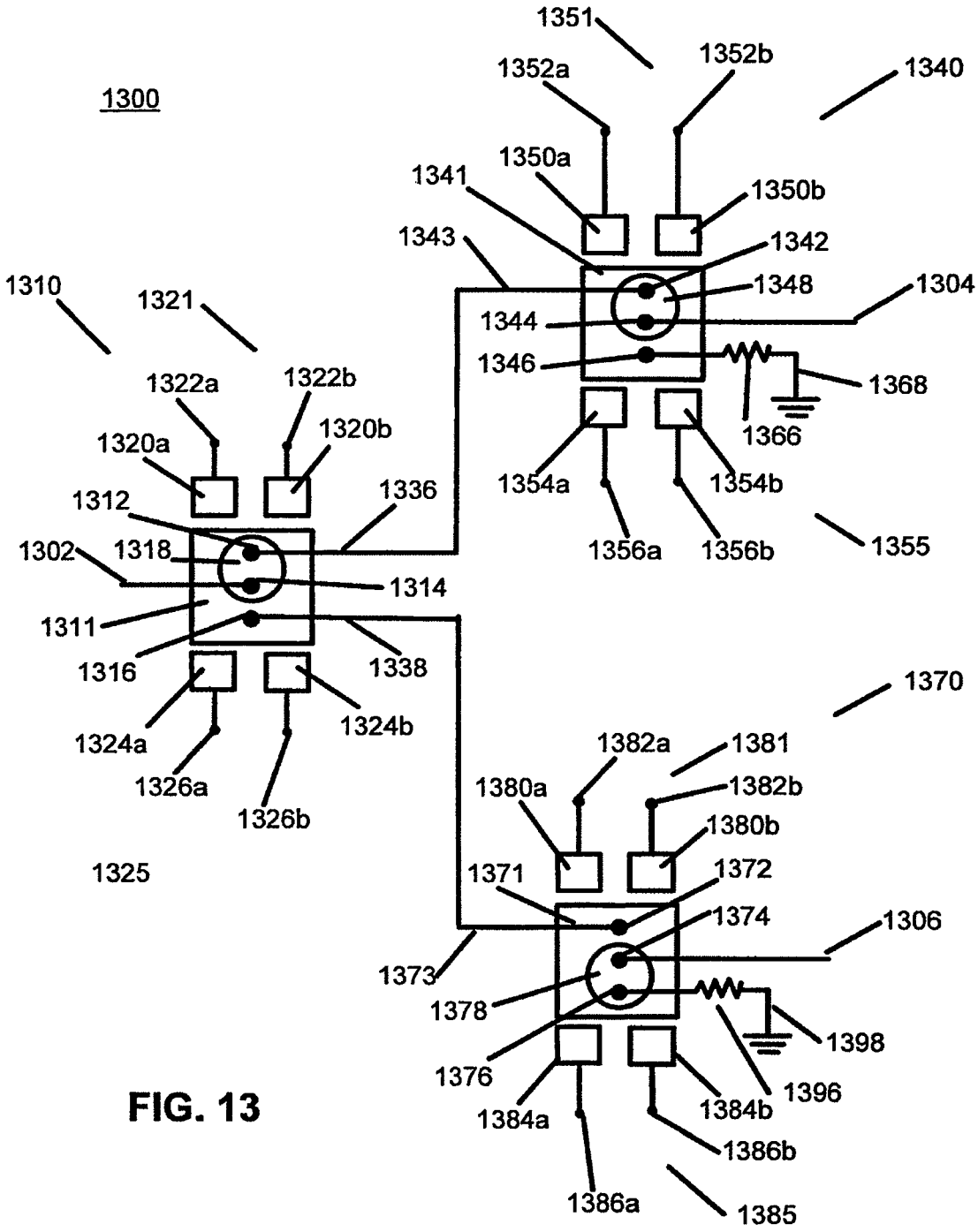
FIG. 13 is a schematic diagram illustrating a circuit for a three-stage liquid metal switch.

FIG. 13 is a schematic diagram illustrating a circuit for a three-stage liquid metal switch employing electrowetting on dielectric (EWOD). The three-stage liquid metal switch 1300 includes a common EWOD switch 1310, a first EWOD switch 1340, and a second EWOD switch 1370. Connections to the three-stage liquid metal switch 1300 include an input port 1302 operably attached to the common EWOD switch 1310 to receive a signal, a first output port 1304 operably attached to the first EWOD switch 1340, and a second output port 1306 operably attached to the second EWOD switch 1370. The three-stage liquid metal switch 1300 can provide multiple contact isolations between the input port 1302 and the outputs—the first output port 1304 and/or the second output port 1306.

Each of the exemplary EWOD switches has one input and two outputs as a single pole, double throw (SPDT) switch. The common EWOD switch 1310 has the input port 1302, a first shared-EWOD-switch output 1336, and a second shared-EWOD-switch output 1338. The first EWOD switch 1340 has a first-EWOD-switch input 1343, the first output port 1304, and a first-EWOD-switch output 1368. The second EWOD switch 1370 has a second-EWOD-switch input 1373, the second output port 1306, and a second-EWOD-switch output 1398. The first shared-EWOD-switch output 1336 is operably connected to the first-EWOD-switch input 1343, and the second shared-EWOD-switch output 1338 is operably connected to the second-EWOD-switch input 1373. In one embodiment, the first-EWOD-switch output 1368 and/or the second-EWOD-switch output 1398 are operably connected to common, such as through 50 ohm resistance 1366 or 50 ohm resistance 1396. Those skilled in the art will appreciate that resistance can provide impedance matching with the input an/or output transmission lines, terminating and isolating the transmission lines.

The common EWOD switch 1310 includes a dielectric surface 1311 with a first contact 1312 operably connected to a first shared-EWOD-switch output 1336, a shared contact 1314 operably connected to the input port 1302, and a second contact 1316 operably connected to a second shared-EWOD-switch output 1338. A shared-EWOD-switch liquid metal droplet 1318 is disposed on the dielectric surface 1311 and switchable between a first shared-EWOD-switch position and a second shared-EWOD-switch position. The example of FIG. 13 shows the shared-EWOD-switch liquid metal droplet 1318 in the first shared-EWOD-switch position. In the first shared-EWOD-switch position, the shared-EWOD-switch liquid metal droplet 1318 operably connects the first contact 1312 and the shared contact 1314, operably connecting the input port 1302 and the first shared-EWOD-switch output 1336. In the second shared-EWOD-switch position, the shared-EWOD-switch liquid metal droplet 1318 operably connects the shared contact 1314 and the second contact 1316, operably connecting the input port 1302 and the second shared-EWOD-switch output 1338.

The common EWOD switch 1310 also includes a first pair of shared-EWOD-switch electrodes 1320*a,b* operably connected to a first pair of shared-EWOD-switch terminals 1322*a,b*, and a second pair of shared-EWOD-switch electrodes 1324*a,b* operably connected to a second pair of shared-EWOD-switch terminals 1326*a,b*. The first pair of shared-EWOD-switch electrodes 1320*a,b* and second pair of shared-EWOD-switch electrodes 1324*a,b* are shown outside of the dielectric surface 1311 for clarity of illustration. The first pair of shared-EWOD-switch electrodes 1320*a,b* is responsive to a first shared-EWOD-switch control signal 1321 provided through the first pair of shared-EWOD-switch terminals 1322*a,b*. The second pair of shared-EWOD-switch electrodes 1324*a,b* is responsive to a second shared-EWOD-switch control signal 1325 provided through the second pair of shared-EWOD-switch terminals 1326*a,b*. Applying voltage across each of the pair of electrodes alters the geometry of the shared-EWOD-switch liquid metal droplet 1318 to translate the droplet between the first shared-EWOD-switch position and the second shared-EWOD-switch position. In one embodiment, the switch control signal, such as first shared-EWOD-switch control signal 1321, is a single voltage control signal, i.e., the same voltage, such as V+ and V+, is applied to shared-EWOD-switch terminal 1322*a* and shared-EWOD-switch terminal 1322*b*. The shared-EWOD-switch liquid metal droplet 1318 is held at a different voltage than the shared-EWOD-switch terminals 1322*a,b*, such as by grounding the shared-EWOD-switch liquid metal droplet 1318 through shared contact 1314 operably connected to the input port 1302. This maintains the voltage difference needed for the EWOD effect. In one embodiment, the switch control signal, such as first shared-EWOD-switch control signal 1321, is a dual voltage control signal, e.g., different voltages, such as V+ and V−, are applied to shared-EWOD-switch terminal 1322*a* and shared-EWOD-switch terminal 1322*b*. The voltage of the shared-EWOD-switch liquid metal droplet 1318 can be allowed to float, because the dual voltage control signal maintains the voltage difference between shared-EWOD-switch terminal 1322*a* and shared-EWOD-switch terminal 1322*b* needed for the EWOD effect.

The first EWOD switch 1340 includes a dielectric surface 1341 with a first contact 1342 operably connected to the first-EWOD-switch input 1343, a shared contact 1344 operably connected to a first output port 1304, and a second contact 1346 operably connected to a first-EWOD-switch output 1368. A first-EWOD-switch liquid metal droplet 1348 is disposed on the dielectric surface 1341 and switchable between a first first-EWOD-switch position and a second first-EWOD-switch position. The example of FIG. 13 shows the first-EWOD-switch liquid metal droplet 1348 in the first first-EWOD-switch position. In the first first-EWOD-switch position of this example, the first-EWOD-switch liquid metal droplet 1348 operably connects the first contact 1342 and the shared contact 1344, operably connecting the first-EWOD-switch input 1343 and the first output port 1304. In the second first-EWOD-switch position of this example, the first-EWOD-switch liquid metal droplet 1348 operably connects the shared contact 1344 and the second contact 1346, operably connecting the first output port 1304 and the first-EWOD-switch output 1368.

The first EWOD switch 1340 also includes a first pair of first-EWOD-switch electrodes 1350*a,b* operably connected to a first pair of first-EWOD-switch terminals 1352*a,b*, and a second pair of first-EWOD-switch electrodes 1354*a,b* operably connected to a second pair of first-EWOD-switch terminals 1356*a,b*. The first pair of first-EWOD-switch electrodes 1350*a,b* and second pair of first-EWOD-switch electrodes 1354*a,b* are shown outside of the dielectric surface 1341 for clarity of illustration. The first pair of first-EWOD-switch electrodes 1350*a,b* is responsive to a first first-EWOD-switch control signal 1351 provided through the first pair of first-EWOD-switch terminals 1352*a,b*. The second pair of first-EWOD-switch electrodes 1354*a,b* is responsive to a second first-EWOD-switch control signal 1355 provided through the second pair of first-EWOD-switch terminals 1356*a,b*. Applying voltage across each of the pair of electrodes alters the geometry of the first-EWOD-switch liquid metal droplet 1348 to translate the droplet between the first first-EWOD-switch position and the second first-EWOD-switch position. In one embodiment, the switch control signal, such as first first-EWOD-switch control signal 1351, is a single voltage control signal, i.e., the same voltage, such as V+ and V+, is applied to first-EWOD-switch terminal 1352*a* and first-EWOD-switch terminal 1352*b*. The first-EWOD-switch liquid metal droplet 1348 is held at a different voltage than the first-EWOD-switch terminals 1352*a,b*, such as by grounding the first-EWOD-switch liquid metal droplet 1348 through shared contact 1344 operably connected to a first output port 1304. This maintains the voltage difference needed for the EWOD effect. In one embodiment, the switch control signal, such as first first-EWOD-switch control signal 1351, is a dual voltage control signal, e.g., different voltages, such as V+ and V−, are applied to first-EWOD-switch terminal 1352*a* and first-EWOD-switch terminal 1352*b*. The voltage of the first-EWOD-switch liquid metal droplet 1348 can be allowed to float, because the dual voltage control signal maintains the voltage difference between first-EWOD-switch terminal 1352*a* and first-EWOD-switch terminal 1352*b* needed for the EWOD effect.

The second EWOD switch 1370 includes a dielectric surface 1371 with a first contact 1372 operably connected to the second-EWOD-switch input 1373, a shared contact 1374 operably connected to a second output port 1306, and a second contact 1376 operably connected to a second-EWOD-switch output 1398. A second-EWOD-switch liquid metal droplet 1378 is disposed on the dielectric surface 1371 and switchable between a first second-EWOD-switch position and a second second-EWOD-switch position. The example of FIG. 13 shows the second-EWOD-switch liquid metal droplet 1378 in the second second-EWOD-switch position. In the second second-EWOD-switch position of this example, the second-EWOD-switch liquid metal droplet 1378 operably connects the shared contact 1374 and the second contact 1376, operably connecting the second output port 1306 and the second-EWOD-switch output 1398. In the first second-EWOD-switch position of this example, the second-EWOD-switch liquid metal droplet 1378 operably connects the first contact 1372 and the shared contact 1374, operably connecting the second-EWOD-switch input 1373 and the second output port 1306.

The second EWOD switch 1370 also includes a first pair of second-EWOD-switch electrodes 1380*a,b* operably connected to a first pair of second-EWOD-switch terminals 1382*a,b*, and a second pair of second-EWOD-switch electrodes 1384*a,b* operably connected to a second pair of second-EWOD-switch terminals 1386*a,b*. The first pair of second-EWOD-switch electrodes 1380*a,b* and second pair of second-EWOD-switch electrodes 1384*a,b* are shown outside of the dielectric surface 1371 for clarity of illustration. The first pair of second-EWOD-switch electrodes 1380*a,b* is responsive to a first second-EWOD-switch control signal 1381 provided through the first pair of second- EWOD-switch terminals 1382*a,b*. The second pair of second-EWOD-switch electrodes 1384*a,b* is responsive to a second second-EWOD-switch control signal 1385 provided through the second pair of second-EWOD-switch terminals 1386*a,b*. Applying voltage across each of the pair of electrodes alters the geometry of the second-EWOD-switch liquid metal droplet 1378 to translate the droplet between the first second-EWOD-switch position and the second second-EWOD-switch position. In one embodiment, the switch control signal, such as first second-EWOD-switch control signal 1381, is a single voltage control signal, i.e., the same voltage, such as V+ and V+, is applied to second-EWOD-switch terminal 1382*a* and second-EWOD-switch terminal 1382*b*. The second-EWOD-switch liquid metal droplet 1378 is held at a different voltage than the second-EWOD-switch terminals 1382*a,b*, such as by grounding the second-EWOD-switch liquid metal droplet 1378 through shared contact 1374 operably connected to a second output port 1306. This maintains the voltage difference needed for the EWOD effect. In one embodiment, the switch control signal, such as first second-EWOD-switch control signal 1381, is a dual voltage control signal, e.g., different voltages, such as V+ and V−, are applied to second-EWOD-switch terminal 1382*a* and second-EWOD-switch terminal 1382*b*. The voltage of the second-EWOD-switch liquid metal droplet 1378 can be allowed to float, because the dual voltage control signal maintains the voltage difference between second-EWOD-switch terminal 1382*a* and second-EWOD-switch terminal 1382*b* needed for the EWOD effect.

In operation, the three-stage liquid metal switch 1300 can connect the input port 1302 to one of the first output port 1304 and the second output port 1306, while providing the isolation of two open contacts to the other of the first output port 1304 and the second output port 1306, which is unconnected. The input port 1302 can be connected to the first output port 1304 by providing a voltage difference between shared-EWOD-switch terminal 1322*a* and 1322*b* as the dual voltage first shared-EWOD-switch control signal 1321, and a voltage difference between first-EWOD-switch terminal 1352*a* and 1352*b* as the dual voltage first first-EWOD-switch control signal 1351. Providing a voltage difference between second-EWOD-switch terminal 1386*a* and 1386*b* as the dual voltage second second-EWOD-switch control signal 1385 yields two open contact isolation between the input port 1302 and the second output port 1306, one at common EWOD switch 1310 and one at second EWOD switch 1370. Removing the voltage difference as the first first-EWOD-switch control signal 1351 and providing a voltage difference between first-EWOD-switch terminal 1352*a* and 1352*b* as the dual voltage second first-EWOD-switch control signal 1355 can isolate the input port 1302 as well. The two open contact isolation is maintained between the input port 1302 and the second output port 1306, and one contact isolation is provided between the input port 1302 and the first output port 1304 at the first EWOD switch 1340.

The switch control signals provided to the pair of switch terminals, such as first shared-EWOD-switch control signal 1321 provided to the first pair of shared-EWOD-switch terminals 1322*a,b*, can be a single voltage control signal or a dual voltage control signal. As defined herein, the single voltage control signal applies the same voltage to both of the pair of switch terminals and the dual voltage control signal applies a different voltage, i.e., a differential voltage, across the pair of switch terminals. Although there is some debate about whether the liquid metal droplet translates due to the effect of differential voltage on the contact angle between the liquid metal droplet and the dielectric surface or due to the electomechanics of the electromagnetic field from the differential voltage, the liquid metal droplet does translate when a control signal is applied. In one example for the common EWOD switch 1310, applying a dual voltage control signal as the first shared-EWOD-switch control signal 1321 to the first pair of shared-EWOD-switch terminals 1322*a,b* translates the shared-EWOD-switch liquid metal droplet 1318 toward the first pair of shared-EWOD-switch electrodes 1320*a,b*. In another example for the common EWOD switch 1310, applying a single voltage control signal having a positive voltage as the first shared-EWOD-switch control signal 1321 to the first pair of shared-EWOD-switch terminals 1322*a,b* and connecting the shared contact 1314 to common translates the shared-EWOD-switch liquid metal droplet 1318 toward the first pair of shared-EWOD-switch electrodes 1320*a,b*. The single and/or dual voltage control signals can be used in various combinations throughout the three-stage liquid metal switch 1300 as desired for a particular application.

Those skilled in the art will appreciate that various combinations of switch positions and port connections are possible as desired for a particular application. In another embodiment, the first-EWOD-switch input 1343 is operably connected to the shared contact 1344 and the first output port 1304 is operably connected to the first contact 1342. In another embodiment, the second-EWOD-switch input 1373 is operably connected to the shared contact 1374 and the second output port 1306 is operably connected to the first contact 1372. Additional layers of isolation can be provided by connecting the output ports as inputs to additional three-stage liquid metal switches or additional EWOD switches.

The common EWOD switch 1310, first EWOD switch 1340, and second EWOD switch 1370 all can be one type of EWOD switch or can be a mixture of EWOD switch types. The EWOD switches can be dual layer EWOD switches as shown in FIGS. 3A–3C, single layer EWOD switches as shown in FIGS. 5A & 5B, interlaced EWOD switches as shown in FIGS. 6A, 6B, 7, & 8, or the like.

The common EWOD switch 1310, first EWOD switch 1340, and second EWOD switch 1370 can include wettability features in their respective dielectric surfaces 1311, 1341, and 1371. Examples of wettability features include surface materials, wetting materials formed over a non-wetting surface, microtexturing, and the like. The common EWOD switch 1310, first EWOD switch 1340, and second EWOD switch 1370 can be disposed on a single dielectric, as desired.

The common EWOD switch 1310, first EWOD switch 1340, and/or second EWOD switch 1370 can be latching or non-latching as desired. In a latching configuration, the liquid metal droplet remains in position when the voltage as the control signal to the pair of electrodes translating the liquid metal droplet is removed. The liquid metal droplet remains in that position until a voltage is applied to translate the liquid metal droplet from that position. In a non-latching configuration, the liquid metal droplet resides in a predetermined position, such as a central or neutral position, when the voltage as the control signal to the pair of electrodes translating the liquid metal droplet is removed. The latching or non-latching configuration can be determined by the nature of the dielectric surface, such as surface material characteristics, surface topography, and the like.

Figure 14:
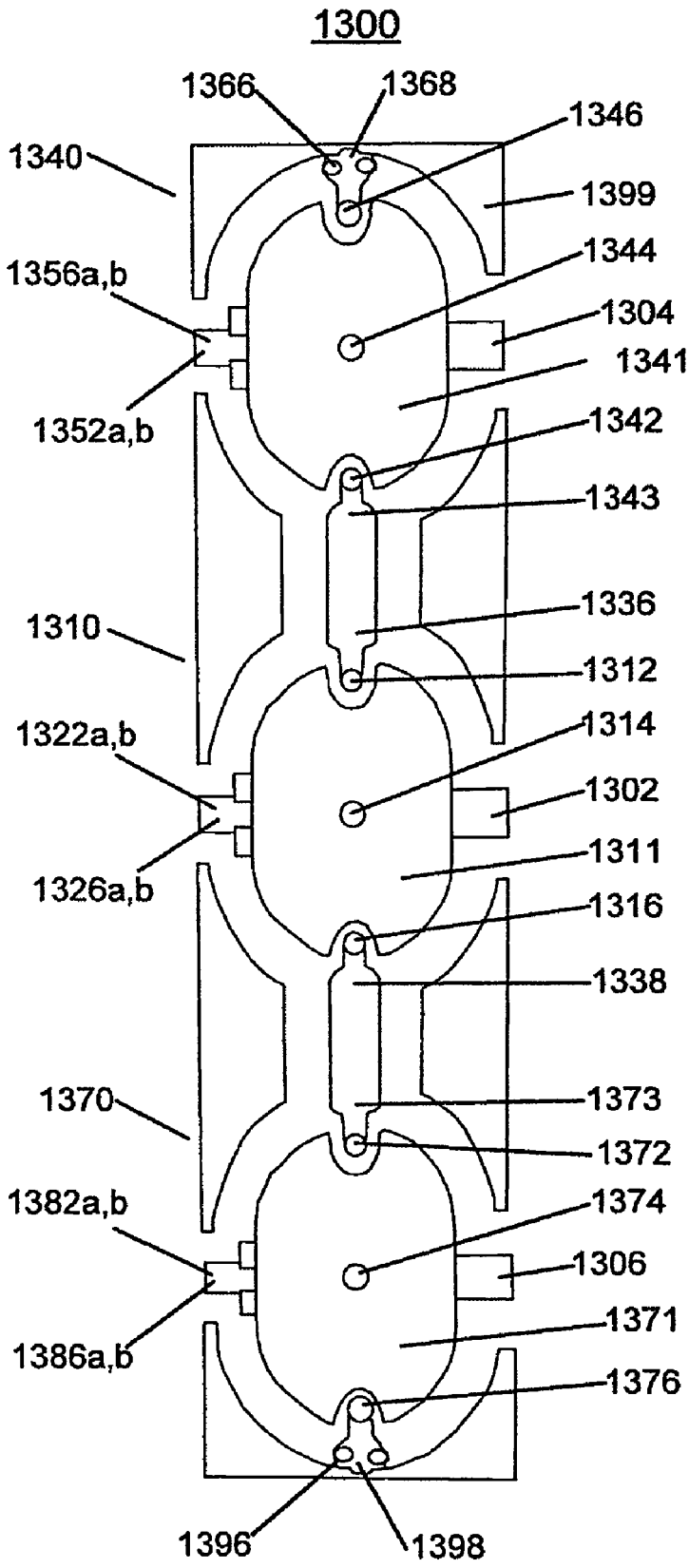
FIG. 14 is a plan view illustrating an embodiment of a three-stage liquid metal switch according to the invention.

FIG. 14, in which like elements share like reference numbers with FIG. 13, is a plan view illustrating an embodiment of a three-stage liquid metal switch according to the invention. The three-stage liquid metal switch 1300 includes a common EWOD switch 1310, a first EWOD switch 1340, and a second EWOD switch 1370. The liquid metal droplets (not shown) for each of the EWOD switches are disposed on their respective dielectric surfaces 1341, 1311, and 1371. A common 1399 is provided for connection of the first-EWOD-switch output 1368 and second-EWOD-switch output 1398 through the resistance 1366 and the resistance 1396, respectively.

Figure 15:
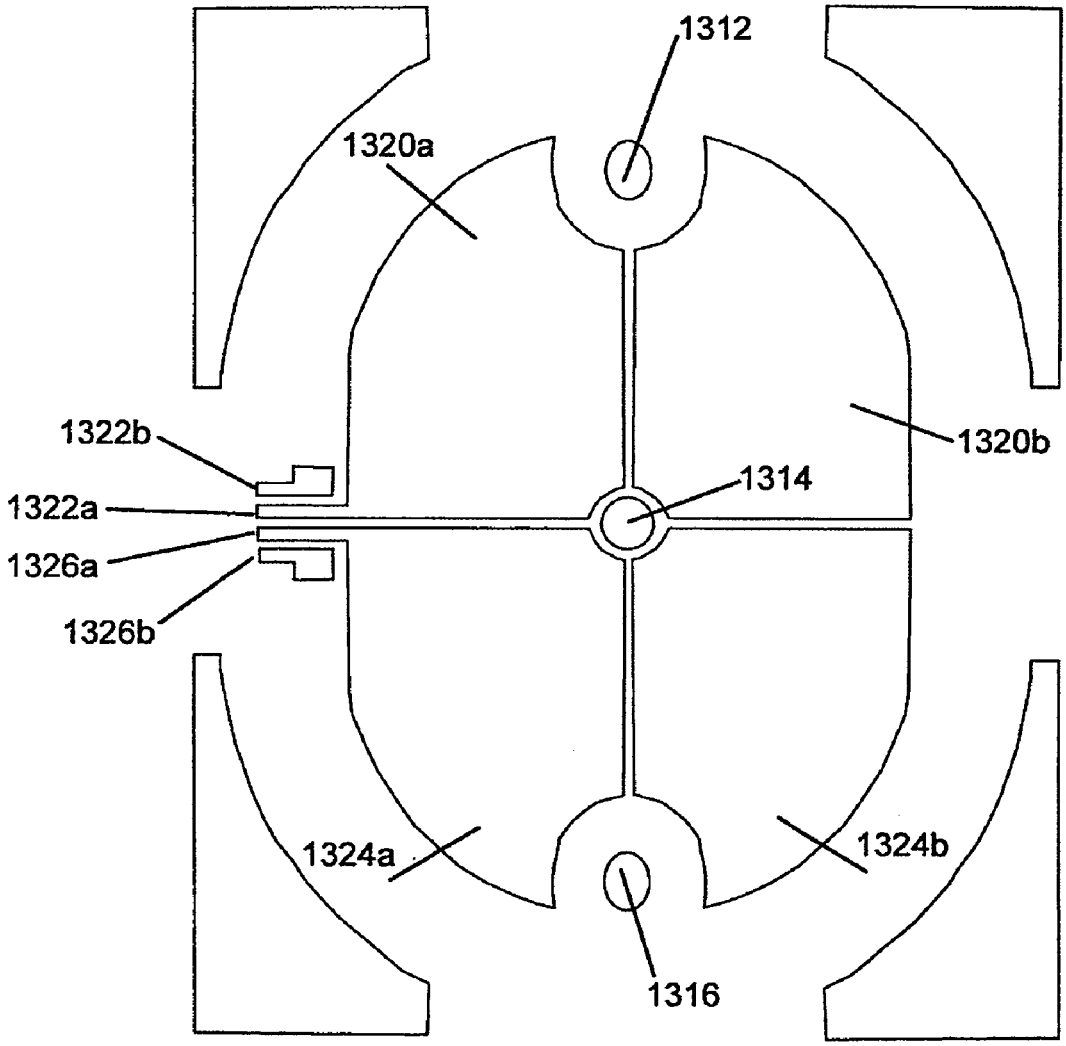
FIG. 15 is a plan view illustrating an electrode layer of one of the liquid metal switches of FIG. 14.

FIG. 15, in which like elements share like reference numbers with FIG. 13, is a plan view illustrating an electrode layer of one of the liquid metal switches of FIG. 14. The electrode layer 1319 of the common EWOD switch 1310 is provided as an example: the electrode layers of the first EWOD switch 1340 and second EWOD switch 1370 are typically similar, although they can be different if different types of EWOD switches are used. The electrode layer 1319 is disposed below the dielectric surface (not shown), with the first pair of electrodes 1320*a,b* operably connected to the first shared-EWOD-switch control signal 1321 and the second pair of electrodes 1324*a,b* operably connected to the second shared-EWOD-switch control signal 1325. Connections between the control signals and the electrodes can be made with vias beneath the electrode layer 1319 as desired. In the example of FIG. 15, the vias connecting shared-EWOD-switch terminal 1322*b* with shared-EWOD-switch electrode 1320*b* and shared-EWOD-switch terminal 1326*b* with shared-EWOD-switch electrode 1324*b* are not shown as they lie beneath the electrode layer 1319. The first contact 1312, shared contact 1314, and second contact 1316 can be formed in the same layer as the electrode layer 1319.

Figure 16A:
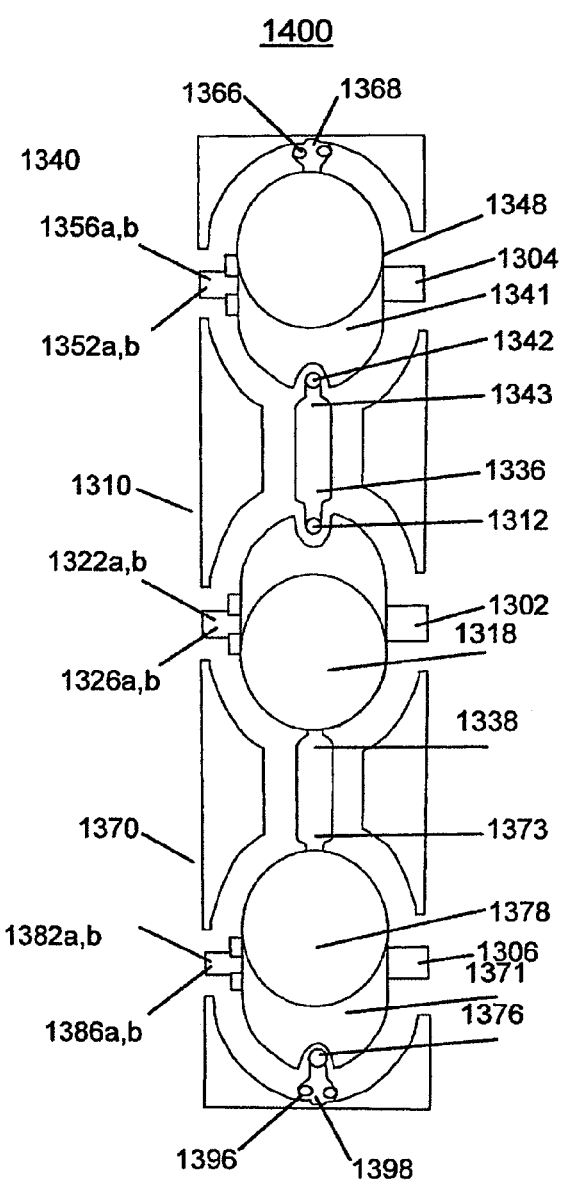
FIG. 16A is a schematic diagram illustrating the three-stage liquid metal switch in a first switching position.

FIGS. 16A & B, in which like elements share like reference numbers with FIG. 13, are schematic diagrams illustrating the three-stage liquid metal switch in first and second switching positions, respectively. In the first switching position, the three-stage liquid metal switch 1300 connects the input port 1302 with the second output port 1306, and the first output port 1304 is isolated. In the second switching position, the three-stage liquid metal switch 1300 connects the input port 1302 with the first output port 1304, and the second output port 1306 is isolated.

Referring to FIG. 16A, the shared-EWOD-switch liquid metal droplet 1318 of the common EWOD switch 1310 disposed on the dielectric surface 1311 is in the second shared-EWOD-switch position. In the second shared-EWOD-switch position, the shared-EWOD-switch liquid metal droplet 1318 operably connects the shared contact (not shown) beneath the liquid metal droplet 1318 and the second contact 1316, operably connecting the input port 1302 and the second shared-EWOD-switch output 1338. The second-EWOD-switch liquid metal droplet 1378 of the second EWOD switch 1370 disposed on the dielectric surface 1371 is in the first second-EWOD-switch position. In the first second-EWOD-switch position, the second-EWOD-switch liquid metal droplet 1378 operably connects the first contact 1372 and the shared contact (not shown) beneath the liquid metal droplet 1378, operably connecting the second-EWOD-switch input 1373 and the second output port 1306.

The first output port 1304 of the first EWOD switch 1340 is terminated and isolated by two open contacts—the first contact 1342 of the first EWOD switch 1340 and the first contact 1312 of the common EWOD switch 1310. The first-EWOD-switch liquid metal droplet 1348 of the first EWOD switch 1340 disposed on the dielectric surface 1341 is in the second first-EWOD-switch position. In the second first-EWOD-switch position, the first-EWOD-switch liquid metal droplet 1348 operably connects the second contact 1346 and the shared contact (not shown) beneath the liquid metal droplet 1348, operably connecting the first-EWOD-switch output 1368 and the first output port 1304.

Figure 16B:
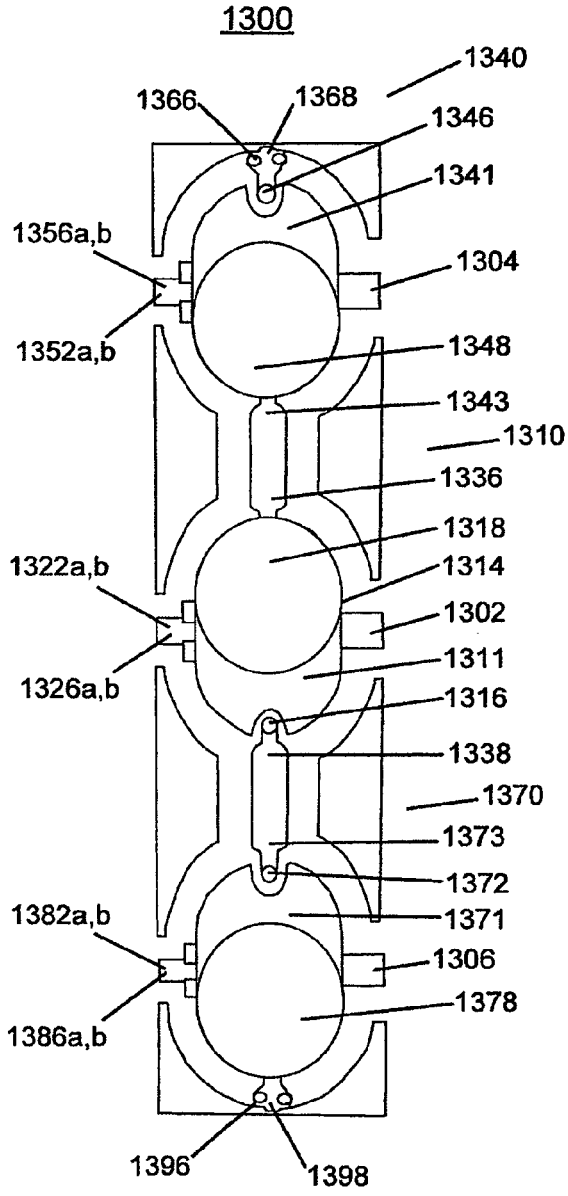
FIG. 16B is a schematic diagram illustrating the three-stage liquid metal switch in a second switching position.

The positions of the liquid metal droplets are switched between the examples of FIG. 16A and FIG. 16B to change the connection of the input port 1302 from the second output port 1306 to the first output port 1304, and the isolation from the first output port 1304 to the second output port 1306. In one embodiment, the EWOD switches are latching, so that the liquid metal droplets remain in position without a voltage as the control signal to the associated pair of electrodes. In another embodiment, the EWOD switches are non-latching, so that the voltage difference is removed from one pair of terminals for the EWOD switch and applied to the other pair of terminals for the EWOD switch. In the example of FIG. 16A and FIG. 16B with the EWOD switches as non-latching switches, dual voltage control signals are applied in FIG. 16A with voltage differences across the second pair of first-EWOD-switch terminals 1356*a,b* as the second first-EWOD-switch control signal 1355, across the second pair of shared-EWOD-switch terminals 1326*a,b* as the second shared-EWOD-switch control signal 1325, and across the first pair of second-EWOD-switch terminals 1382*a,b* as the first second-EWOD-switch control signal 1381. The liquid metal droplets are translated to the switching position in the example of FIG. 16B by applying dual voltage control signals as voltage differences across the first pair of first-EWOD-switch terminals 1352*a,b* as the first first-EWOD-switch control signal 1351, across the first pair of shared-EWOD-switch terminals 1322*a,b* as the first shared-EWOD-switch control signal 1321, and across the second pair of second-EWOD-switch terminals 1386*a,b* as the second second-EWOD-switch control signal 1385. Those skilled in the art will appreciate that the voltage differences as dual voltage control signals can be applied to the three-stage liquid metal switch 1300 in various combinations to achieve the switch configuration desired. In another embodiment, one or more of the control signals can be single voltage control signals and the voltage difference applied between both of a pair of the switch terminals and an input or output port operably connected to a shared contact.

Referring to FIG. 16B, the shared-EWOD-switch liquid metal droplet 1318 is in the first shared-EWOD-switch position, operably connecting the first contact 1312 and the shared contact (not shown) beneath the liquid metal droplet 1318 to operably connect the input port 1302 and the first shared-EWOD-switch output 1336. The first-EWOD-switch liquid metal droplet 1348 is in the first first-EWOD-switch position operably connecting the shared contact (not shown) beneath the liquid metal droplet 1348 and the first contact 1342 to operably connect the first output port 1304 and the first-EWOD-switch input 1343. The second output port 1306 of the second EWOD switch 1370 is terminated and isolated by two open contacts—the first contact 1372 of the second EWOD switch 1370 and the second contact 1316 of the common EWOD switch 1310. The second-EWOD-switch liquid metal droplet 1378 is in the second second-EWOD-switch position, operably connecting the shared contact (not shown) beneath the liquid metal droplet 1378 and the second contact 1376 to operably connect the second output port 1306 and the second-EWOD-switch output 1398.

This disclosure describes the invention in detail using illustrative embodiments. However, it is to be understood that the invention defined by the appended claims is not limited to the precise embodiments described.

We claim:

1. A three-stage liquid metal switch employing electrowetting on dielectric (EWOD), comprising:

a common EWOD switch 1310 having an input port 1302, a first shared-EWOD-switch output 1336, and a second shared-EWOD-switch output 1338;

a first EWOD switch 1340 having a first-EWOD-switch input 1343, a first output port 1304, and a first-EWOD-switch output 1368; and a second EWOD switch 1370 having a second-EWOD-switch input 1373, a second output port 1306, and a second-EWOD-switch output 1398;

wherein the first shared-EWOD-switch output 1336 is operably connected to the first-EWOD-switch input 1343, and the second shared-EWOD-switch output 1338 is operably connected to the second-EWOD-switch input 1373.

2. The switch of claim 1, wherein the first-EWOD-switch output 1368 is operably connected to common.

3. The switch of claim 1, wherein the common EWOD switch 1310 is selected from the group consisting of a dual layer EWOD switch, a single layer EWOD switch, and an interlaced EWOD switch.

4. The switch of claim 1, wherein the first EWOD switch 1340 is selected from the group consisting of dual layer EWOD switch, a single layer EWOD switch, and an interlaced EWOD switch.

5. The switch of claim 1, wherein the common EWOD switch 1310, the first EWOD switch 1340, and the second EWOD switch 1370 are disposed on a dielectric.

6. The switch of claim 1, wherein the common EWOD switch 1310 comprises a dielectric having a dielectric surface 1311, a liquid metal droplet 1318 disposed on the dielectric surface 1311, and at least one pair of electrodes 1320*a,b*, the liquid metal droplet 1318 being switchable in response to a control signal 1321 to the at least one pair of electrodes 1320*a,b* between a first position operably connecting the input port 1302 to the first shared-EWOD-switch output 1336 and a second position operably connecting the input port 1302 to the second shared-EWOD-switch output 1338.

7. The switch of claim 6, wherein the at least one pair of electrodes 1320*a,b* comprises a first pair of electrodes 1320*a,b* and a second pair of electrodes 1324*a,b*, the control signal 1321 comprises a first control signal 1321 and a second control signal 1325, the first pair of electrodes 1320*a,b* translates the liquid metal droplet 1318 to the first position in response to the first control signal 1321, and the second pair of electrodes 1324*a,b* translates the liquid metal droplet 1318 to the second position in response to the second control signal 1325.

8. The switch of claim 6, wherein the dielectric surface 1311 has wettability features.

9. The switch of claim 6, wherein the liquid metal droplet 1318 latches in at least one of the first position and the second position.

10. The switch of claim 6, wherein the control signal 1321 is selected from the group consisting of single voltage control signals and dual voltage control signals.

11. The switch of claim 1, wherein the first EWOD switch 1340 comprises a dielectric having a dielectric surface 1341, a liquid metal droplet 1348 disposed on the dielectric surface 1341, and at least one pair of electrodes 1350*a,b*, wherein the liquid metal droplet 1348 is switchable in response to a control signal 1351 to the at least one pair of electrodes 1350*a,b* between a first position and a second position.

12. The switch of claim 11 wherein the at least one pair of electrodes 1350*a,b* comprises a first pair of electrodes 1350*a,b* and a second pair of electrodes 1354*a,b*, the control signal 1351 comprises a first control signal 1351 and a second control signal 1355, the first pair of electrodes 1350*a,b* translates the liquid metal droplet 1348 to the first position in response to the first control signal 1351, and the second pair of electrodes 1354*a,b* translates the liquid metal droplet 1348 to the second position in response to the second control signal 1355.

13. The switch of claim 11, wherein the liquid metal droplet 1348 latches in at least one of the first position and the second position.

14. A three-stage liquid metal switch, comprising:

a first liquid metal droplet;

means for supporting the first liquid metal droplet;

means for translating the first liquid metal droplet between a first first-switch position operably connecting an input port to a first first-switch output and a second first-switch position operably connecting the input port to a second first-switch output in response to a first control signal;

a second liquid metal droplet;

means for supporting the second liquid metal droplet;

means for translating the second liquid metal droplet between a first second-switch position and a second second-switch position in response to a second control signal, the first second-switch position operably connecting a second-switch input and a first output port;

a third liquid metal droplet;

means for supporting the third liquid metal droplet;

means for translating the third liquid metal droplet between a first third-switch position and a second third-switch position in response to a third control signal, the first third-switch position operably connecting a third-switch input and a second output port;

wherein the first first-switch output is operably connected to the second-switch input and the second first-switch output is operably connected to the third-switch input.

15. The switch of claim 14, further comprising means for wetting at least one of the first liquid metal droplet supporting means, the second liquid metal droplet supporting means, and the third liquid metal droplet supporting means.

16. The switch of claim 14, further comprising means for latching the first liquid metal droplet in one of the first shared-switch position and the second shared-switch position.

17. The switch of claim 14, further comprising means for latching the second liquid metal droplet in one of the first second-switch position and the second second-switch position.

18. The switch of claim 14, further comprising means for terminating and isolating the first output port.

19. The three-stage liquid metal switch employing electrowetting on dielectric (EWOD), comprising:

a common EWOD switch 1310, the common EWOD switch 1310 having an input port 1302, a first shared-EWOD-switch output 1336, a second shared-EWOD-switch output 1338, a shared-EWOD-switch liquid metal droplet 1318, and at least one pair of shared-EWOD-switch electrodes 1320*a,b*, the shared-EWOD-switch liquid metal droplet 1318 being switchable in response to a shared-EWOD-switch control signal 1321 to the at least one pair of shared-EWOD-switch electrodes 1320*a,b* between a first shared-EWOD-switch position operably connecting the input port

1302 and the first shared-EWOD-switch output 1336 and a second shared-EWOD-switch position operably connecting the input port 1302 and the second shared-EWOD-switch output 1338;

a first EWOD switch 1340, the first EWOD switch 1340 having a first-EWOD-switch input 1343, a first output port 1304, a first-EWOD-switch output 1368, a first-EWOD-switch liquid metal droplet 1348, and at least one pair of first-EWOD-switch electrodes 1350*a,b*, the first-EWOD-switch liquid metal droplet 1348 being switchable in response to a first-EWOD-switch control signal 1351 to the at least one pair of first-EWOD-switch electrodes 1350*a,b* between a first first-EWOD-switch position and a second first-EWOD-switch position; and a second EWOD switch 1370, the second EWOD switch 1370 having a second-EWOD-switch input 1373, a second output port 1306, a second-EWOD-switch output 1398, a second-EWOD-switch liquid metal droplet 1378, and at least one pair of second-EWOD-switch electrodes 1380*a,b*, the second-EWOD-switch liquid metal droplet 1378 being switchable in response to a second-EWOD-switch control signal 1381 to the at least one pair of second-EWOD-switch electrodes 1380*a,b* between a first second-EWOD-switch position and a second second-EWOD-switch position;

wherein the first shared-EWOD-switch output 1336 is operably connected to the first-EWOD-switch input 1343, and the second shared-EWOD-switch output 1338 is operably connected to the second-EWOD-switch input 1373.

20. The switch of claim 19, wherein the first-EWOD-switch output 1368 is operably connected to common.

* * * * *